US010358687B2

(12) United States Patent
Akiba et al.

(10) Patent No.: US 10,358,687 B2
(45) Date of Patent: Jul. 23, 2019

(54) HOT STAMP MOLDED BODY, AND METHOD FOR PRODUCING HOT STAMP MOLDED BODY

(71) Applicant: NIPPON STEEL & SUMITOMO METAL CORPORATION, Tokyo (JP)

(72) Inventors: Kojiro Akiba, Tokyo (JP); Yusuke Kondo, Tokyo (JP); Yoshitaka Kikuchi, Tokyo (JP); Satoshi Kato, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 161 days.

(21) Appl. No.: 14/897,479

(22) PCT Filed: Jun. 6, 2014

(86) PCT No.: PCT/JP2014/065113
§ 371 (c)(1),
(2) Date: Dec. 10, 2015

(87) PCT Pub. No.: WO2014/199923
PCT Pub. Date: Dec. 18, 2014

(65) Prior Publication Data

US 2016/0122845 A1 May 5, 2016

(30) Foreign Application Priority Data

Jun. 11, 2013 (JP) ..... 2013-122351

(51) Int. Cl.

| | |
|---|---|
| ***C21D 9/46*** | (2006.01) |
| ***C22C 38/02*** | (2006.01) |
| ***C22C 38/06*** | (2006.01) |
| ***C22C 38/12*** | (2006.01) |
| ***C22C 38/58*** | (2006.01) |
| ***C25D 3/22*** | (2006.01) |
| ***C25D 5/50*** | (2006.01) |
| ***C25D 7/06*** | (2006.01) |
| ***C21D 8/04*** | (2006.01) |
| ***C21D 9/48*** | (2006.01) |
| ***C21D 9/56*** | (2006.01) |

(Continued)

(52) U.S. Cl.
CPC ..... *C21D 9/46* (2013.01); *B21D 22/00* (2013.01); *C21D 1/673* (2013.01); *C21D 6/004* (2013.01); *C21D 6/005* (2013.01); *C21D 6/008* (2013.01); *C21D 8/0205* (2013.01); *C21D 8/0226* (2013.01); *C21D 8/0236* (2013.01); *C21D 8/0263* (2013.01); *C21D 8/0278* (2013.01); *C21D 8/0473* (2013.01); *C21D 9/48* (2013.01); *C21D 9/561* (2013.01); *C22C 38/001* (2013.01); *C22C 38/002* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/22* (2013.01); *C22C 38/32* (2013.01); *C22C 38/38* (2013.01); *C22C 38/58* (2013.01); *C25D 3/22* (2013.01); *C25D 5/36* (2013.01); *C25D 5/48* (2013.01); *C25D 5/50* (2013.01); *C25D 7/00* (2013.01); *C25D 7/0614* (2013.01)

(58) Field of Classification Search
CPC ..... B21D 22/00; C21D 1/673; C21D 6/004; C21D 6/005; C21D 6/008; C21D 8/0205; C21D 8/0226; C21D 8/0236; C21D 8/0263; C21D 8/0278; C21D 8/0473; C21D 9/46; C21D 9/48; C21D 9/561; C22C 38/001; C22C 38/002; C22C 38/02; C22C 38/04; C22C 38/06; C22C 38/08; C22C 38/12; C22C 38/14; C22C 38/22; C22C 38/32; C22C 38/38; C22C 38/58; C25D 3/22; C25D 5/36; C25D 5/48; C25D 5/50; C25D 7/00; C25D 7/0614
See application file for complete search history.

(56) References Cited

U.S. PATENT DOCUMENTS

2004/0234807 A1 11/2004 Suzuki et al.
2005/0115052 A1 6/2005 Takahashi et al.

FOREIGN PATENT DOCUMENTS

CN 101680048 A 3/2010
DE 102010056265 B3 5/2012

(Continued)

OTHER PUBLICATIONS

Chinese Office Action, dated Aug. 2, 2016, for Chinese Application No. 201480032840.4, together with a partial English translation thereof.

(Continued)

*Primary Examiner* — Jenny R Wu
(74) *Attorney, Agent, or Firm* — Birch, Stewart, Kolasch & Birch, LLP

(57) ABSTRACT

A hot stamp molded body that can be produced highly efficiently without causing sticking of plating to a mold, when an electrogalvanized steel sheet with a light plating weight is hot-stamped using a rapidly heating method such as Joule heating and induction heating, and can secure favorable paint adhesiveness without a posttreatment such as shotblasting after hot stamping, as well as a method for producing the same. A hot stamp molded body is produced by hot-stamping an electrogalvanized steel sheet which is composed of predetermined components, and is electrogalvanized on each face with a plating weight not less than 5 $g/m^2$ and less than 40 $g/m^2$; and therein a galvanized layer of the hot stamp molded body is configured with 0 $g/m^2$ to 15 $g/m^2$ of a Zn—Fe intermetallic compound and a Fe—Zn solid solution phase as a balance, and in the galvanized layer of the hot stamp molded body 1×10 pcs to $1\times10^4$ pcs of particulate matter with an average diameter of from 10 nm to 1 μm are present per 1 mm length of the galvanized layer.

6 Claims, 11 Drawing Sheets

(51) Int. Cl.

| | |
|---|---|
| ***C21D 1/673*** | (2006.01) |
| ***B21D 22/00*** | (2006.01) |
| ***C21D 6/00*** | (2006.01) |
| ***C21D 8/02*** | (2006.01) |
| ***C22C 38/00*** | (2006.01) |
| ***C22C 38/04*** | (2006.01) |
| ***C22C 38/08*** | (2006.01) |
| ***C22C 38/14*** | (2006.01) |
| ***C22C 38/22*** | (2006.01) |
| ***C22C 38/32*** | (2006.01) |
| ***C22C 38/38*** | (2006.01) |
| ***C25D 5/36*** | (2006.01) |
| ***C25D 5/48*** | (2006.01) |
| ***C25D 7/00*** | (2006.01) |

(56) References Cited

FOREIGN PATENT DOCUMENTS

| | | | |
|---|---|---|---|
| EP | 2159292 | A1 | 3/2010 |
| JP | 04-191354 | | 7/1992 |
| JP | 07-116900 | | 5/1995 |
| JP | 2000-038640 | | 2/2000 |
| JP | 2001-353548 | | 12/2001 |
| JP | 2002-102980 | | 4/2002 |
| JP | 2003-002058 | | 1/2003 |
| JP | 2003-126921 | | 5/2003 |
| JP | 2005-074464 | | 3/2005 |
| JP | 2005-113233 | | 4/2005 |
| JP | 2008-285706 | A | 11/2008 |
| JP | 2011-173135 | | 9/2011 |
| JP | 2011-202205 | | 10/2011 |
| JP | 2012-017495 | | 1/2012 |
| JP | 2012-233249 | | 11/2012 |
| KR | 10-2010-0019500 | A | 2/2010 |

OTHER PUBLICATIONS

International Search Report dated Sep. 2, 2014 issued in corresponding International Application No. PCT/JP2014/065113 [with English translation].

Korean Office Action for corresponding Korean Application No. 10-2015-7036398, dated Mar. 29, 2017, with a Partial English translation.

Extended European Search Report, dated Feb. 2, 2017, for European Application No. 14810534.9.

In a case in which there is no residual Zn-Fe intermetallic compound

In a case in which the remaining amount of a Zn-Fe intermetallic compound is 15 g/m$^2$ or less.

In a case in which the remaining amount of a Zn-Fe intermetallic compound is beyond 15 g/m$^2$.

HOT STAMP MOLDED BODY, AND METHOD FOR PRODUCING HOT STAMP MOLDED BODY

CROSS REFERENCE TO RELATED APPLICATIONS

This application is a national stage application of International Application No. PCT/JP2014/065113, filed Jun. 6, 2014, which claims priority to Japanese Application No. 2013-122351, filed Jun. 11, 2013, the content of which is incorporated herein by reference.

TECHNICAL FIELD

The present invention relates to a hot stamp molded body, which is a component molded and quenched at the same time by hot press molding, and applied mainly to a skeletal component, a reinforcing component, a chassis component, or the like of an automobile body, and a method for producing the same.

BACKGROUND ART

In recent years, for the sake of weight reduction of an automobile leading to improvement in fuel efficiency, weight reduction of a steel sheet to be used by increasing the strength of a steel sheet has been endeavored. However, when the strength of a steel sheet to be used is increased, there occurs a problem of occurrence of scoring or steel sheet fracture during molding, or instability of the shape of a molded item due to a spring-back phenomenon.

As a technology for producing a high strength component, there is a method by which the strength is increased after press molding, instead of pressing a high strength steel sheet. An example of the same is hot stamp molding. Hot stamp molding is a method by which a steel sheet to be molded is heated in advance for facilitating molding, and subjected to press molding keeping the high temperature as also described in Patent Literature 1, and 2. As a molding material therefor, a quenchable steel grade is selected, and a higher strength is achieved by quenching on the occasion of cooling after pressing. By this procedure, the strength of a steel sheet can be enhanced at the same time as press molding without conducting a separate heat treatment step for strength increase after press molding.

However, since hot stamp molding is a molding method by which a heated steel sheet is processed, formation of a Fe scale by surface oxidation of the steel sheet is unavoidable. Even in a case in which a steel sheet is heated in a non-oxidizing atmosphere, when the sheet is taken out from a heating furnace for press molding, a Fe scale is formed on a surface due to exposure to the air. Further, heating in such a non-oxidizing atmosphere is costly.

In a case in which a Fe scale is formed on a steel sheet surface during heating, the Fe scale may be peeled off during pressing to stick to a mold, so as to develop such a problem that the productivity of pressing may be impaired, or the Fe scale remains on a product after pressing to disfeature the appearance. Further, in a case in which such an oxide film remains, since a Fe scale on a surface of a molded item is poor in adhesiveness, when a conversion treatment and painting are performed on a molded item without removing the scale, a problem in paint adhesiveness will be developed.

Therefore, ordinarily a Fe scale is removed by applying a sandblasting treatment or a shotblasting treatment after hot stamping, and thereafter a conversion treatment or painting is carried out as described in Patent Literature 3. However, such a blasting treatment is troublesome, and impairs remarkably the productivity of hot stamping. Further, a strain may be generated in a molded item.

Meanwhile, a technology, by which hot stamping is conducted on a zinc-based coated steel sheet or an aluminum coated steel sheet, while suppressing Fe scale generation, has been disclosure in Patent Literature 4 to 6. Further, a technology for preforming a hot press on a coated steel sheet is also disclosed in Patent Literature 7 to 10.

Further, a method for producing a zinc-based coated steel sheet is disclosed in Patent Literature 11 and 12.

Patent Literature 1: Japanese Patent Application Laid-Open (JP-A) No. H07-116900
Patent Literature 2: JP-A No. 2002-102980
Patent Literature 3: JP-A No. 2003-2058
Patent Literature 4: JP-A No. 2000-38640
Patent Literature 5: JP-A No. 2001-353548
Patent Literature 6: JP-A No. 2003-126921
Patent Literature 7: JP-A No. 2011-202205
Patent Literature 8: JP-A No. 2012-233249
Patent Literature 9: JP-A No. 2005-74464
Patent Literature 10: JP-A No. 2003-126921
Patent Literature 11: JP-A No. H04-191354
Patent Literature 12: JP-A No. 2012-17495

SUMMARY OF INVENTION

Technical Problem

However, in a case in which an aluminum coated steel sheet, especially a hot-dip aluminum coated steel sheet is hot-stamped, counter diffusion of a plated layer and a steel matrix material takes place during steel sheet heating and an intermetallic compound, such as Fe—Al and Fe—Al—Si, is formed at a plating interface. Further, an oxide film of aluminum is formed on a surface of a plated layer. The aluminum oxide film compromises paint adhesiveness, although not so seriously as an iron oxide film, and cannot necessarily satisfy such severe paint adhesiveness as required for an automobile outer plate, a chassis component, etc. Further, it is difficult to form a conversion coating used broadly as a painting surface treatment.

Meanwhile, in a case in which a zinc-based coated steel sheet, especially a hot-dip zinc coated steel sheet is hot-stamped, a Zn—Fe intermetallic compound or a Fe—Zn solid solution phase is formed by counter diffusion of a plated layer and a steel matrix material during steel sheet heating, and a Zn-based oxide film is formed on the outermost surface. The compound, phase, or oxide film does not impair paint adhesiveness or conversion treatability, unlike the aluminum-based oxide film.

In recent years, as a producing process for a steel sheet for hot stamping, a technique by which a steel sheet can be rapidly heated by Joule heating or induction heating has been acquiring popularity. In this case, the total of the temperature elevation time and the retention time at hot stamping is frequently less than 1 min. When a zinc-based coated steel sheet is hot-stamped under such conditions, a soft plated layer sticks to a mold, which requires frequent maintenance works of a mold, and therefore there has been a drawback in that the productivity is impaired.

An object of the invention is to overcome the above problems and to provide a hot stamp molded body that can be produced highly efficiently without causing sticking of plating to a mold, when an electrogalvanized steel sheet with a light plating weight is hot-stamped using a rapidly heating method such as Joule heating and induction heating, and can secure favorable paint adhesiveness without a posttreatment such as shotblasting after hot stamping, as well as a method for producing the same.

Solution to Problem

The essentials of the invention are as follows.

[1] A hot stamp molded body produced by hot-stamping an electrogalvanized steel sheet comprising as components of a steel sheet, by mass %:

C: from 0.10 to 0.35%,
Si: from 0.01 to 3.00%,
Al: from 0.01 to 3.00%,
Mn: from 1.0 to 3.5%,
P: from 0.001 to 0.100%,
S: from 0.001 to 0.010%,
N: from 0.0005 to 0.0100%,
Ti: from 0.000 to 0.200%,
Nb: from 0.000 to 0.200%,
Mo: from 0.00 to 1.00%,
Cr: from 0.00 to 1.00%,
V: from 0.000 to 1.000%,
Ni: from 0.00 to 3.00%,
B: from 0.0000 to 0.0050%,
Ca: from 0.0000 to 0.0050%, and
Mg: from 0.0000 to 0.0050%,
a balance being Fe and impurities, wherein the steel sheet is electrogalvanized on each face with a plating weight not less than 5 $g/m^2$ and less than 40 $g/m^2$;

wherein a galvanized layer of the hot stamp molded body is configured with 0 $g/m^2$ to 15 $g/m^2$ of a Zn—Fe intermetallic compound and a Fe—Zn solid solution phase as a balance, and wherein in the galvanized layer of the hot stamp molded body, 1×10 pcs to $1\times10^4$ pcs of particulate matter with an average diameter of from 10 nm to 1 μm are present per 1 mm length of the galvanized layer.

[2] The hot stamp molded body according to [1] above, wherein the steel sheet comprises, by mass %, one, or two or more kinds of:

Ti: from 0.001 to 0.200%,
Nb: from 0.001 to 0.200%,
Mo: from 0.01 to 1.00%,
Cr: from 0.01 to 1.00%,
V: from 0.001 to 1.000%,
Ni: from 0.01 to 3.00%,
B: from 0.0002 to 0.0050%,
Ca: from 0.0002 to 0.0050%, or
Mg: from 0.0002 to 0.0050%.

[3] The hot stamp molded body according to [1] or [2] above, wherein the particulate matter is one, or two or more kinds of oxides containing one, or two or more kinds out of Si, Mn, Cr or Al.

[4] The hot stamp molded body according to any one of claims [1] to [3] above, wherein the electrogalvanized steel sheet is an electrolytic zinc alloy-coated steel sheet.

[5] A method for producing a hot stamp molded body, in which a steel comprising as components, by mass %:

C: from 0.10 to 0.35%,
Si: from 0.01 to 3.00%,
Al: from 0.01 to 3.00%,
Mn: from 1.0 to 3.5%,
P: from 0.001 to 0.100%,
S: from 0.001 to 0.010%,
N: from 0.0005 to 0.0100%,
Ti: from 0.000 to 0.200%,
Nb: from 0.000 to 0.200%,
Mo: from 0.00 to 1.00%,
Cr: from 0.00 to 1.00%,
V: from 0.000 to 1.000%,
Ni: from 0.00 to 3.00%,
B: from 0.0000 to 0.0050%,
Ca: from 0.0000 to 0.0050%, and
Mg: from 0.0000 to 0.0050%,
a balance being Fe and impurities, is subjected to a hot rolling step, a pickling step, a cold rolling step, a continuous annealing step, a temper rolling step, and an electrogalvanizing step to yield an electrogalvanized steel sheet, and the electrogalvanized steel sheet is subjected to a hot stamp molding step to produce a hot stamp molded body;

wherein in the continuous annealing step, the steel sheet is subjected to repeated bending at a bending angle of from 90° to 220° four or more times during heating of the steel sheet in an atmosphere gas containing hydrogen at from 0.1 volume % to 30 volume %, and $H_2O$ corresponding to a dew point of from −70° C. to −20° C. as well as nitrogen and impurities as a balance at a sheet temperature within a range of from 350° C. to 700° C., wherein in the electrogalvanizing step, each face of the steel sheet is electrogalvanized with a plating weight of not less than 5 $g/m^2$ and less than 40 $g/m^2$, and wherein in the hot stamp molding step, the electrogalvanized steel sheet is heated with an average temperature elevation rate of 50° C./sec or more to a temperature range of from 700° C. to 1100° C., hot-stamped within 1 min from the initiation of the temperature elevation, and thereafter cooled to normal temperature.

[6] The method for producing r a hot stamp molded body according to [5] above, wherein the steel comprises, by mass %, one, or two or more kinds of:

Ti: from 0.001 to 0.200%,
Nb: from 0.001 to 0.200%,
Mo: from 0.01 to 1.00%,
Cr: from 0.01 to 1.00%,
V: from 0.001 to 1.000%,
Ni: from 0.01 to 3.00%,
B: from 0.0002 to 0.0050%,
Ca: from 0.0002 to 0.0050%, and
Mg: from 0.0002 to 0.0050%.

Advantageous Effects of Invention

According to the invention, a hot stamp molded body that can be produced highly efficiently without causing sticking of plating to a mold, when an zinc coated steel sheet with a light plating weight is hot-stamped using a rapidly heating method such as Joule heating and induction heating, and can secure favorable paint adhesiveness without a posttreatment such as shotblasting after hot stamping, as well as a method for producing the same can be provided.

DESCRIPTION OF EMBODIMENTS

The invention will be described in detail below. A numerical range expressed herein by "x to y" includes, unless otherwise specified, the values of x and y in the range as the minimum and maximum values respectively.

The inventor conducted hot stamp molding using electrogalvanized steel sheets with a plurality of plating weights under various heating conditions. As the results, it has been made clear that sticking of plating to a mold can be suppressed with a structure, in which the amount of a Zn—Fe intermetallic compound in a plated layer after heating for hot stamping is controlled within 0 g/m$^2$ to 15 g/m$^2$, and a balance is a Fe—Zn solid solution phase, wherein a particulate matter with a predetermined size is present in the plated layer in an appropriate amount. The details will be described below.

Figure 1:
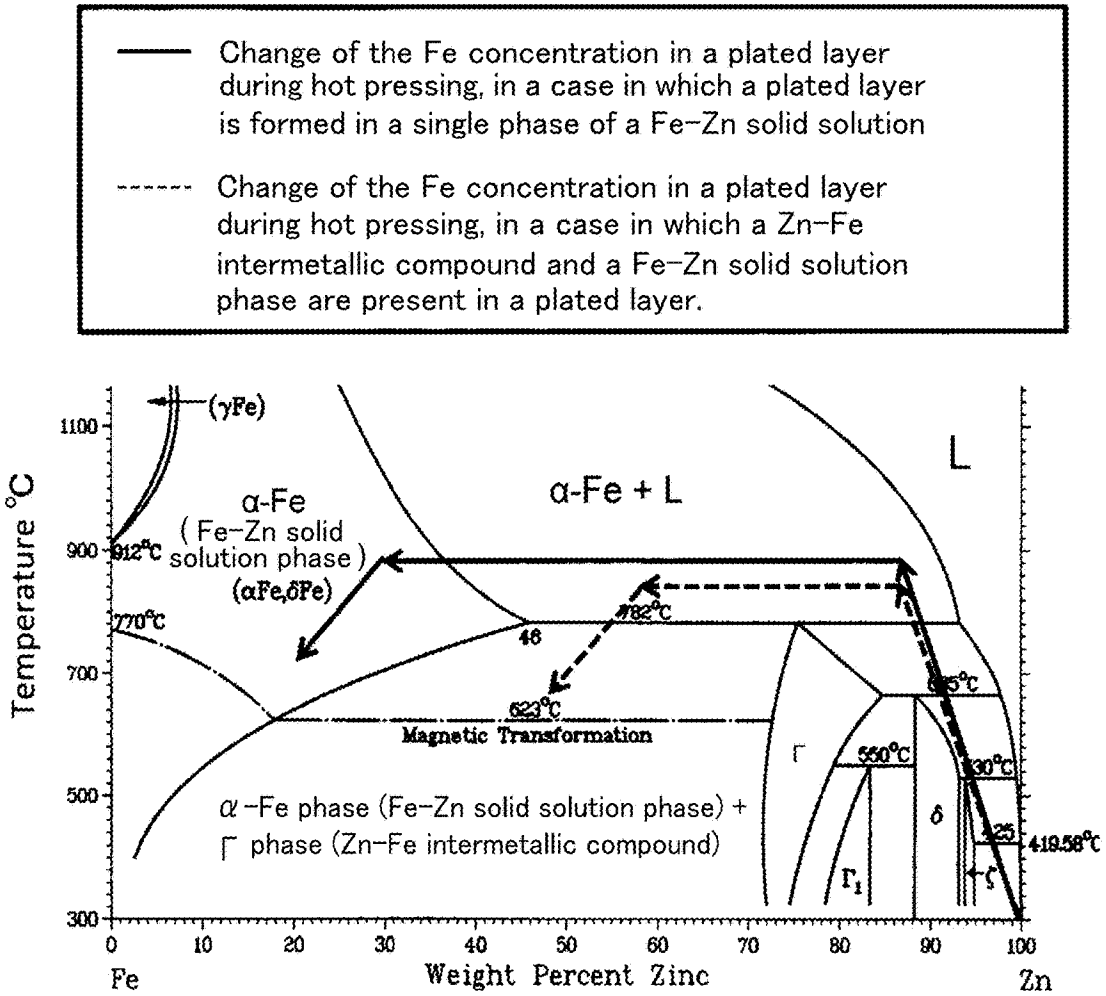
FIG. 1 is a diagram showing a heat history during heating for hot stamping, increase in a Fe concentration in a plated layer, and a phase change of a tissue.

Since a Zn—Fe intermetallic compound is soft in a high temperature condition in which a hot stamp molding is conducted, the Zn—Fe intermetallic compound may stick to a mold, when the Zn—Fe intermetallic compound receives a sliding action during pressing. Therefore, as shown in FIG. 1, the Fe concentration in a plated layer is increased by promoting a Zn—Fe alloying reaction by heating. When a structure, in which a Zn—Fe intermetallic compound composed of a 64 phase ($Fe_3Zn_{10}$) is not present in a steel sheet surface and only a Fe—Zn solid solution phase composed of an α-Fe phase is present (the solid line arrow in the Figure), is formed by the above means, sticking of plating to a mold can be suppressed. Further, it has been known that, even when a Zn—Fe intermetallic compound remains, insofar as the remaining amount is 15 g/m$^2$ or less, such severe sticking of plating to a mold as disturbs production does not occur.

Figure 2:
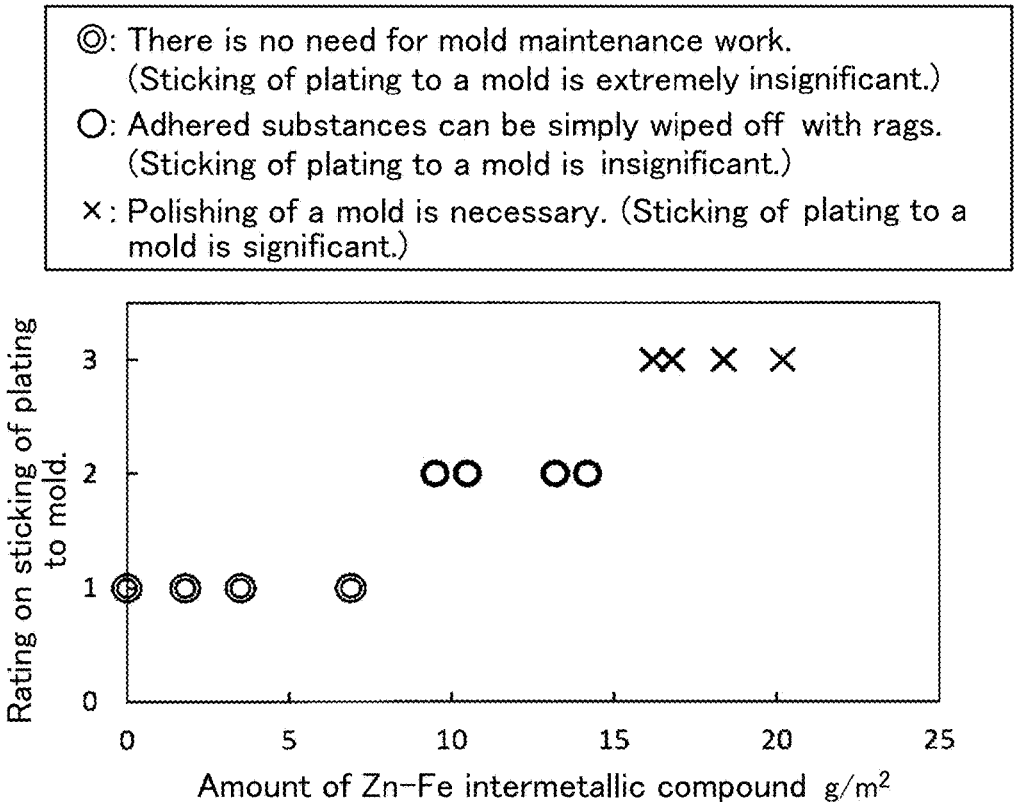
FIG. 2 is a graph showing a relationship between the remaining amount of a Zn—Fe intermetallic compound after heating for hot stamping and the degree of sticking of plating to a mold.

Next, a relationship between the remaining amount of a Zn—Fe intermetallic compound after heating for hot stamping and the degree of sticking of plating to a mold is shown in FIG. 2. When an electrogalvanized steel sheet with a plating weight of 30 g/m$^2$ was heated to 850° C., then cooled to 680° C., and hot-stamped, the remaining amount of a Zn—Fe intermetallic compound was regulated by adjusting the retention time at 850° C. Then, the relationship between the remaining amount of a Zn—Fe intermetallic compound and the sticking to a mold after heating for hot stamping was determined. Based on the remaining amount of a Zn—Fe intermetallic compound after hot stamping, evaluation of the remaining amount of a Zn—Fe intermetallic compound was graded in; a double circle: there is no need for mold maintenance work (sticking of plating to a mold is extremely insignificant), a circle: adhered substances can be simply wiped off with rags, or the like (sticking of plating to a mold is insignificant), and a cross mark: polishing of a mold is necessary (sticking of plating to a mold is significant), wherein a double circle and a circle were deemed as acceptable as on-specification. As obvious from FIG. 2, when the remaining amount of a Zn—Fe intermetallic compound exceeds 15 g/m$^2$, the degree of sticking of plating to a mold becomes severer.

Figure 3A:
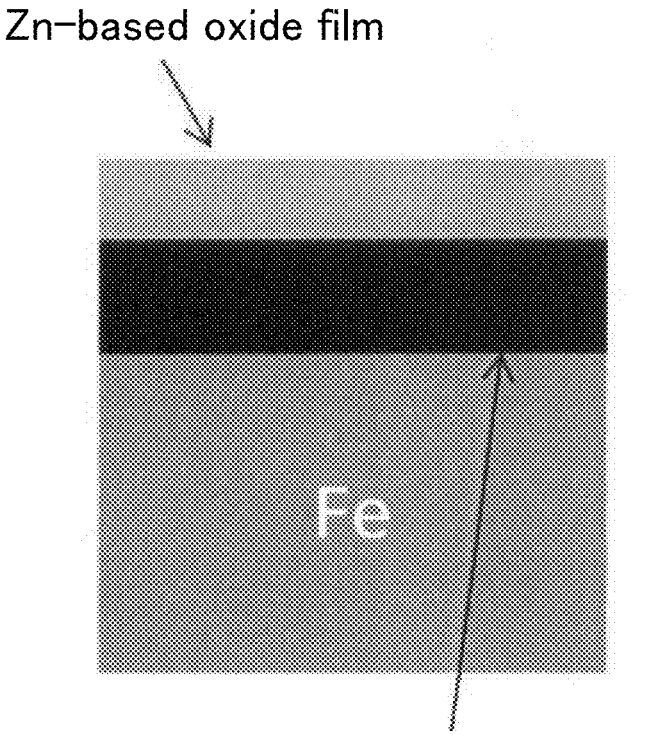
FIG. 3A is a schematic diagram showing a relationship between the remaining amount of a Zn—Fe intermetallic compound after heating for hot stamping and the structure of a plated layer in a case in which a residual Zn—Fe intermetallic compound is not present.
Figure 3B:
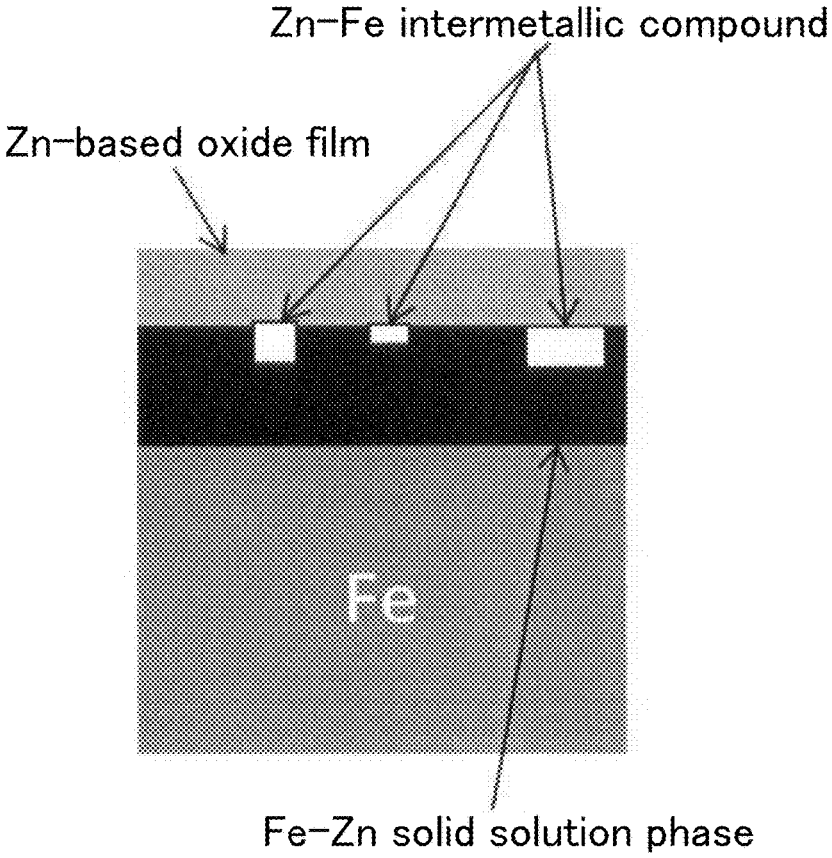
FIG. 3B is a schematic diagram showing a relationship between the remaining amount of a Zn—Fe intermetallic compound after heating for hot stamping and the structure of a plated layer in a case in which the remaining amount of a Zn—Fe intermetallic compound is 15 g/m$^2$ or less.
Figure 3C:
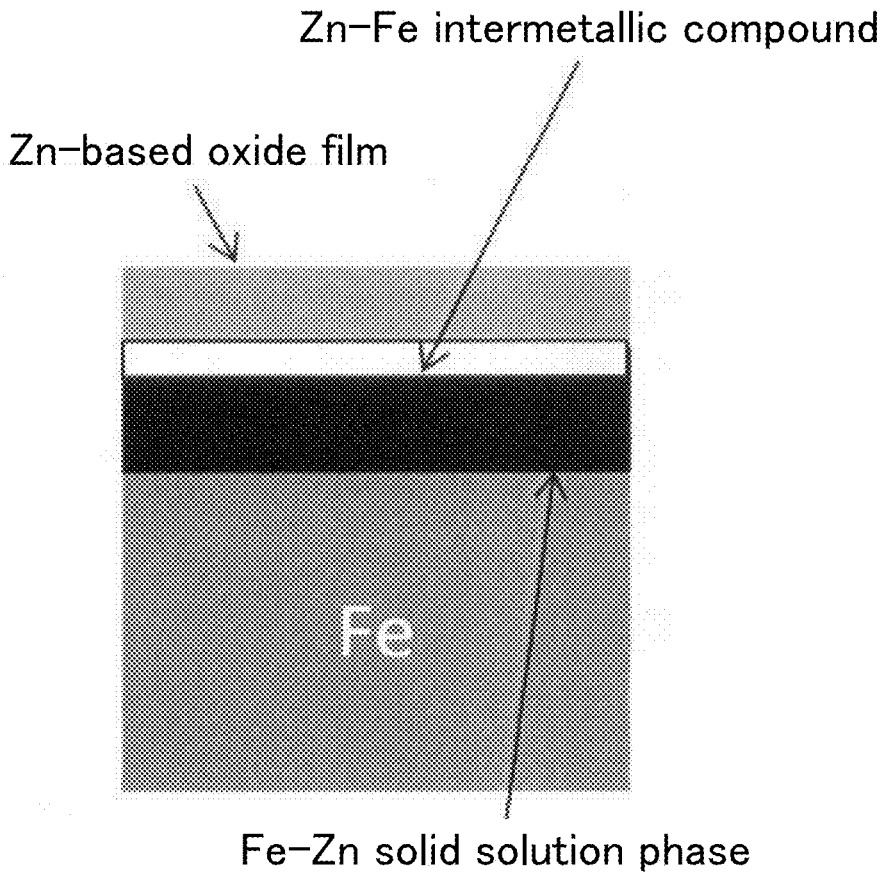
FIG. 3C is a schematic diagram showing a relationship between the remaining amount of a Zn—Fe intermetallic compound after heating for hot stamping and the structure of a plated layer in a case in which the remaining amount of a Zn—Fe intermetallic compound is beyond 15 g/m$^2$.

The reasons, although based on a presumption, are described referring to FIG. 3A to FIG. 3C. FIG. 3A to FIG. 3C are schematic diagrams showing a relationship between the remaining amount of a Zn—Fe intermetallic compound after heating for hot stamping and the structure of a plated layer. When the remaining amount of a Zn—Fe intermetallic compound is 15 g/m$^2$ or less, a Zn—Fe intermetallic compound does not cover any surface of a steel sheet, or remains in a state where the compound is present in small pieces as shown in FIG. 3A and FIG. 3B, and therefore sticking of plating to a mold presumably occurs hardly. Meanwhile, when the remaining amount of a Zn—Fe intermetallic compound exceeds 15 g/m$^2$, a Zn—Fe intermetallic compound covers the entire surface of a steel sheet as shown in FIG. 3C, and therefore sticking of plating to a mold presumably occurs easily.

In this regard, after heating for hot stamping, there is only a slight or almost no change in the amount of a Zn—Fe intermetallic compound before and after hot stamping (pressing). Consequently, the amount of a Zn—Fe intermetallic compound after heating for hot stamping may be examined after cooling before hot stamping (pressing), or may be examined on a formed body after hot stamping (pressing). In other words, when the amount of a Zn—Fe intermetallic compound remaining in a plated layer of a hot-pressed body is from 0 g/m$^2$ to 15 g/m$^2$, sticking of plating to a mold can be suppressed.

Further, in recent years in need of rapid heating for productivity improvement, a technique for heating rapidly a steel sheet, such as Joule heating and induction heating, has been introduced in a producing process for a hot stamp molded body. In this case, the temperature elevation rate can be 50° C./s or more on the occasion of hot stamping, and in most cases the total of temperature elevation time and retention time is 1 min or less. In order to reduce the remaining amount of a Zn—Fe intermetallic compound to 15 g/m$^2$ or less near the outer surface layer of a steel sheet after hot stamping, it is required to adjust the plating weight according to the heating time or the heating temperature.

In order to mitigate sticking of plating to a mold, the amount of a Zn—Fe intermetallic compound in a plated layer after heating is preferably 0 g/m$^2$. However, when the remaining amount of a Zn—Fe intermetallic compound is 15 g/m$^2$ or less, a Zn—Fe intermetallic compound is in a formation state, in which the compound does not cover the entire surface of a steel sheet, rather remains in small pieces, and sticking of plating to a mold as severe as obstructive to production does not occur. The remaining amount of a Zn—Fe intermetallic compound is preferably 10 g/m$^2$ or less.

An amount of a Zn—Fe intermetallic compound in a plated layer after heating is determined by constant current electrolysis of the sample at 4 mA/cm$^2$ in a 150 g/L aqueous solution of $NH_4Cl$ using a saturated calomel electrode as a reference electrode. Namely, a weight of a Zn—Fe intermetallic compound per unit area can be determined by measuring a time period, when the electric potential is −800 mV vs. SCE or less during execution of the constant current electrolysis, and deriving a quantity of electricity flown per unit area during the time period. Meanwhile, although not quantitatively, existence or nonexistence of a Zn—Fe intermetallic compound can be roughly estimated by observation of a backscattered electron image.

In a production process of a hot stamp molded body, a steel sheet is ordinarily heated to approx. from 700° C. to 1100° C. It has come to be known, in a case in which a sheet is heated to the steel sheet temperature by the rapid heating, that the remaining amount of a Zn—Fe intermetallic compound disadvantageously exceeds 15 g/m$^2$. This is because the total duration of heating is short to follow the dotted line pattern in FIG. 1 so that a Fe—Zn solid solution phase cannot be secured sufficiently, and rather a Zn—Fe intermetallic compound tends to be formed. Additionally, in the case of conventional radiant heat transfer heating, there appears a temperature gradient for heat transfer from the surface of a steel sheet to the inside so that there appears a gradient in the thickness direction of a plated layer with respect to formation of a Zn—Fe intermetallic compound, however in the case of rapid heating by Joule heating, induction heating, or the like, since a heating current flows along the steel sheet surface, the steel sheet surface, namely the entire plated layer is rapidly and actively heated, so that a Zn—Fe intermetallic compound is presumably formed uniformly in the thickness direction of the plated layer.

Consequently, in order to avoid generation of a Zn—Fe intermetallic compound, subject to conditions, such as a heating temperature and a retention time, a strategy for avoidance of increase in a generation amount of a Zn—Fe intermetallic compound was decided such that the plating weight of an original plated layer was tried to be reduced and its preferable range was narrowed.

Figure 4:
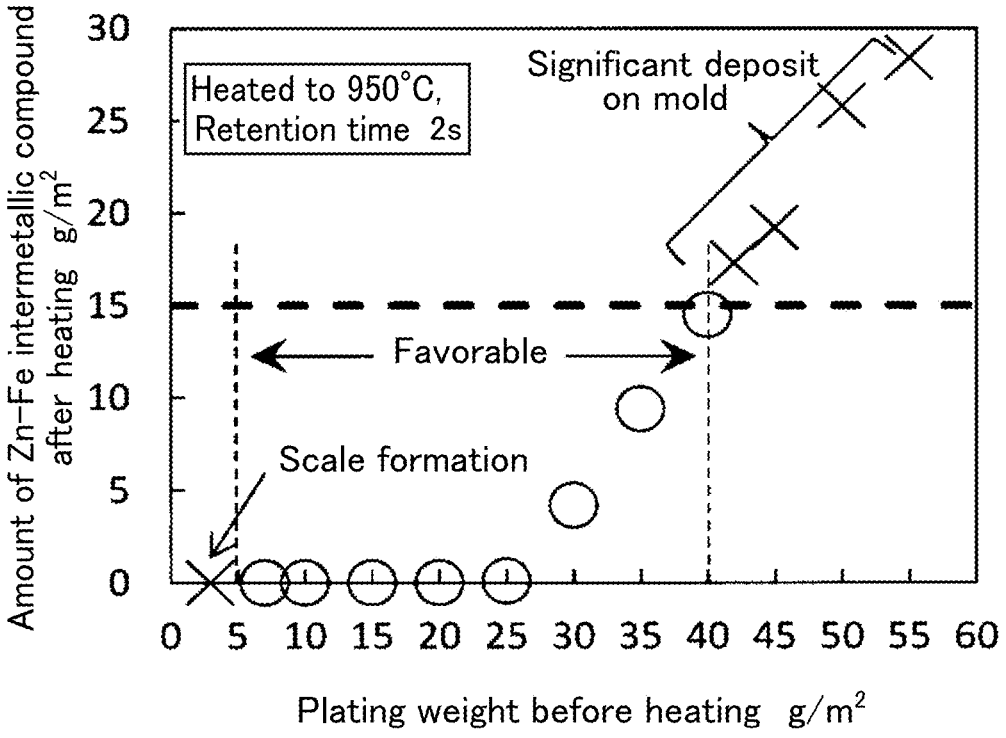
FIG. 4 is a graph showing a relationship between a Zn plating weight before hot stamping and the amount of a Zn—Fe intermetallic compound after plating.

FIG. 4 shows a relationship between a plating weight before heating for hot stamping and the amount of a Zn—Fe intermetallic compound after heating for hot stamping. The above is a result with respect to a steel sheet, which was heated in the air at a rate of 50° C./s to a temperature of 950° C., maintained there for 2 s, then cooled at a rate of 20° C./s to 680° C., and pressed.

When a plating weight is 40 g/m$^2$ or more, a Zn—Fe intermetallic compound in a plated layer can be hardly decreased to 15 g/m$^2$ or less. Therefore, in the present process, a plating weight is required to be less than 40 g/m$^2$.

Since a plating weight is required to be 5 g/m$^2$ or more from a viewpoint of suppression of scaling during heating for hot stamping, this value is deemed as the lower limit.

The plating weight is preferably from 10 g/m$^2$ to 30 g/m$^2$.

Meanwhile, in a case in which electrogalvanized coating is electric zinc alloy plating, the amount of Zn in a plated layer is from the same viewpoints from 5 g/m$^2$ to 40 g/m$^2$, and preferably from 10 g/m$^2$ to 30 g/m$^2$.

In this regard, for measuring a plating weight and a Zn amount, a broadly prevailing analytical method for a plating weight and a Zn amount can be applied without a hitch, for example, a measurement of a plating weight and a Zn amount can be performed by dipping a plated steel sheet in a hydrochloric acid solution containing hydrochloric acid at a concentration of 5% and a corrosion inhibitor for pickling at a temperature of 25° C. until the plating is dissolved, and analyzing the obtained solution by a ICP emission analyzer.

Although an electrogalvanized coating may be either of electric zinc plating, and electric zinc alloy plating, electric zinc alloy plating is preferable. Namely, a steel sheet for hot stamp molding is preferably an electrolytic zinc alloy-coated steel sheet.

However, in the case of electrogalvanized coating with a light plating weight, when an electrogalvanized steel sheet with a small plating weight was heated by a rapidly heating method as described above and subjected to hot stamp molding, there arose a new problem that the paint adhesiveness of a formed body after hot stamping became inferior.

The reasons behind the above are presumed as follows. When a heating time is short and the plating weight is small, a Zn-based oxide film to be formed during heating on the outermost surface of a plated layer becomes also thin, and a Zn—Fe alloying reaction advances rapidly before a Zn-based oxide film grows sufficiently so that most part of Zn in the plated layer is consumed in a Fe—Zn solid solution phase. Presumably, a Zn-based oxide film can grow when a plated layer is in a form of Zn—Fe intermetallic compound, in which the Zn activity is relatively high, but when a plated layer comes to take a form of Fe—Zn solid solution phase, the growth is not any more possible due to increase in the Fe activity and decrease in the Zn activity. In the case of a thin Zn-based oxide film, when a steel sheet receives a sliding action during pressing, a Fe—Zn solid solution phase is exposed easily where Fe scales are formed presumably, and the paint adhesiveness becomes inferior.

In order to improve the paint adhesiveness of a formed body, the inventors carried out hot stamping tests using electrogalvanized steel sheets produced under various conditions. As the result, it was found, through observation of a steel sheet cross-section tissue of a formed body having favorable paint adhesiveness, that a Zn-based oxide film was not peeled off and could remain mostly on a steel sheet surface, when there were a certain amount of fine particulate matters with an average diameter of 1 μm or less.

Further, it was confirmed that the paint adhesiveness of such a hot stamp molded body was superior to a case where a particulate matter is not present.

The particulate matters were analyzed to find that they were mostly an oxide containing an easily oxidizable element contained in steel, such as Si, Mn, Cr, and Al.

To study the phenomenon that the adhesiveness of a Zn-based oxide film is superior, when there are a certain amount of fine particulate matters (mainly an oxide as described below) in a plated layer, the tissue of a steel sheet which was heated at the same condition as for hot stamp molding but not pressed and directly cooled was investigated. As the result, it has been known that when there are a certain amount of fine particulate matters in a plated layer, moderate ruggedness appears at an interface between a Zn-based oxide film and a plated layer. Since it was known that when an interface had a complex morphology, a keying effect at the interface developed generally to improve the paint adhesiveness, it was presumed that the adhesiveness of a Zn-based oxide film was enhanced similarly by a keying effect, and exposure of a Fe—Zn solid solution phase was suppressed during pressing and therefore generation of the Fe scale was avoided to enhance the paint adhesiveness.

A particulate matter causing formation of moderate ruggedness at the interface is considered as follows.

It is presumed from the component and the generation amount that a particulate matter is an oxide of not an impurity element in a plated layer, but mainly an element contained in steel, which has been conceivably present before heating for hot stamping at an interface between a plated layer and a steel matrix, or inside a steel matrix. Further, it is believed that the oxide has been formed in a steel sheet production process during annealing of a steel sheet after cold rolling.

It is believed that, when an oxide is present at an interface between a plated layer and a steel matrix, the oxide exhibits generally a barrier effect so as to suppress locally a Zn—Fe alloying reaction during heating for hot stamping. It is, however, further believed that in the case of a fine particulate oxide with an average diameter of 1 μm or less, the suppression effect on a Zn—Fe alloying reaction is weak, and therefore influence of an oxide at an interface on a Zn—Fe alloying reaction is small.

Meanwhile, when an oxide is formed inside a steel matrix, by pinning a crystal grain boundary near a steel sheet surface during annealing, growth of a crystal grain is suppressed. When a crystal grain near a steel sheet surface is small, and the number of crystal grain boundaries is large, the Zn—Fe alloying reaction rate becomes high. In other words, where an inside oxide is present, a Zn—Fe alloying reaction is conceivably becomes high locally.

Examples of the oxide mentioned here include, but are not particularly limited to, oxides containing one, or two or more kinds out of Si, Mn, Cr or Al. Specific examples include single oxides, such as MnO, $MnO_2$, $Mn_2O_3$, $Mn_3O_4$, $SiO_2$, $Al_2O_3$, and $Cr_2O_3$, and single oxides with a non-stoichiometric composition corresponding to each of these; complex oxides, such as $FeSiO_3$, $Fe_2SiO_4$, $MnSiO_3$, $Mn_2SiO_4$, $AlMnO_3$, $FeCr_2O_4$, $Fe_2CrO_4$, $MnCr_2O_4$, and $Mn_2CrO_4$, and complex oxides with a non-stoichiometric composition corresponding to each of these; and complex structures of these.

Further, since a particle other than an oxide can suppress growth of a crystal grain in a steel sheet surface during annealing by a pinning effect, a sulfide containing one or two kinds out of Fe, Mn, etc., or a nitride containing one or two kinds out of Al, Ti, Mn, Cr, etc., present in the same region, where the oxide is formed, as an inclusion can be a particle having the same effect as the oxide. However, since the amounts of a sulfide and a nitride are very small (for example, approx. 0.1 pc per 1 mm of a plated layer length) compared to an oxide, the influence is small, and it is conceivably enough to take an oxide into consideration according to the invention.

In a case in which the pinning effect by a particulate matter composed of the oxides, etc. for suppressing crystal grain growth exercises an influence on a crystal grain boundary so as to make a change in a progress of a Zn—Fe alloying reaction, ruggedness appears at the interface presumably according to the following mechanism.

In a process of heating for hot stamping, a plated layer and a steel matrix react firstly to form a Zn—Fe intermetallic compound, and at the same time form a Zn-based oxide film on a surface of a plated layer. It has been known that a Zn-based oxide film grows through inward diffusion of oxygen from the atmosphere. Namely, the interface between an oxide film and an intermetallic compound moves toward the intermetallic compound side in step with growth of an oxide film.

So long as a Zn—Fe intermetallic compound remains, owing to high Zn activity at an interface between a Zn-based oxide film and a Fe—Zn intermetallic compound, a Zn-based oxide film can grow. On the other hand, when a Zn—Fe alloying reaction further progresses and a Zn—Fe intermetallic compound disappears to end up with a Zn—Fe solid solution phase, the Fe activity in a plated layer increases so that a Zn-based oxide film cannot grow any more.

In a case in which a Zn—Fe alloying rate is locally different, when the alloying reaction is terminated at a certain time point during heating, it is conceivable that there coexist a region where plating is already converted to a Fe—Zn solid solution phase and a region where a Zn—Fe intermetallic compound remains. Theretofore, it has been conceived that ruggedness appears at an interface by going through such a process so that the thickness of a Zn-based oxide film differs from a region to a region after heating for hot stamping.

With respect to the average diameter of a particulate matter composed of an oxide, etc. existing at a certain amount in a plated layer after heating for hot stamping, the lower limit is 0.01 μm (10 nm), because for exercising an influence on a Zn—Fe alloying behavior, a certain size is necessary. Meanwhile, when the average diameter of a particulate matter is too large, a region where a single particulate matter has influence on the progress of an alloying reaction becomes large, and it becomes actually difficult to form ruggedness. Therefore the upper limit is 1 μm. The average diameter of a particulate matter is therefore preferably from 50 nm to 500 nm.

Figure 5:
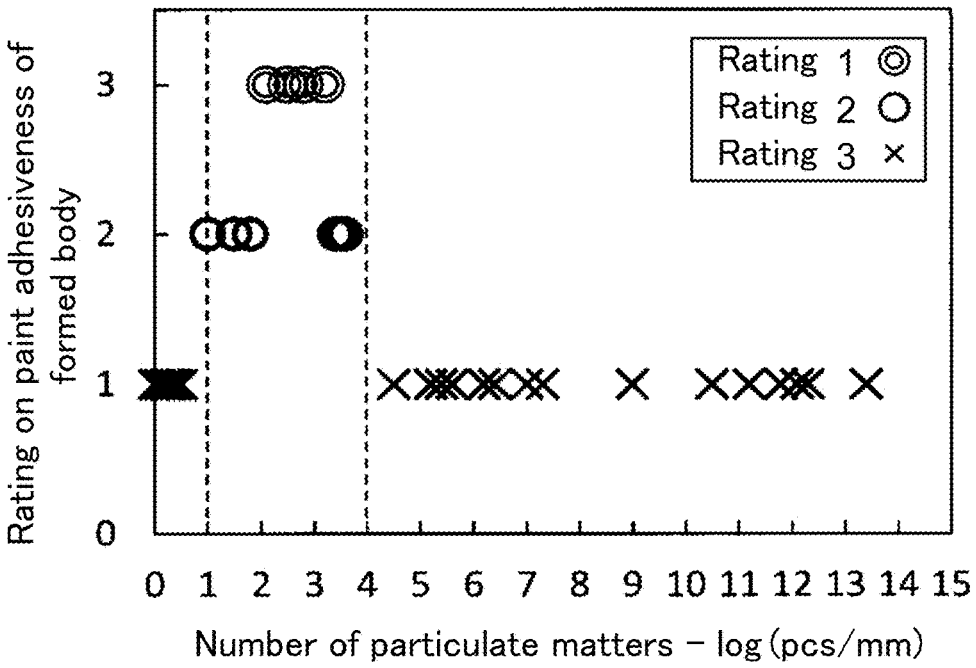
FIG. 5 is a graph showing a relationship between the formation amount of an oxide inside a steel sheet and the paint adhesiveness.

With respect to the density of particulate matters suitable for formation of ruggedness and improvement of paint adhesiveness, presence of 1×10 pcs or more per 1 mm of the plated layer length as shown in FIG. 5 is necessary, when a cross-section is observed. When the density is too low, an effect for forming ruggedness at an interface cannot be obtained. Meanwhile, when there exist beyond $1\times10^4$ pcs, most of crystal grains in a surface of a steel sheet are micronized due to an crystal grain pinning effect of a particulate matter, and local fluctuation of the Zn—Fe alloying rate cannot be generated. Therefore the upper limit is $1\times10^4$ pcs. From the above it is clear that, when the number of particulate matters is from 1×10 to $1\times10^4$ pcs, the paint adhesiveness can be superior. The amount of particulate matters was regulated as described above by changing an annealing condition during production of a steel sheet so as to change the number of particulate matters (particulate oxide) to be formed inside the steel sheet. Further, an observation plane for particulate matters present inside a plated layer per 1 mm of the plated layer length may be in any of the sheet width direction, the longitudinal direction, and a direction angled thereto, insofar as it is per 1 mm of the plated layer length.

In the paint adhesiveness evaluation test, a hot stamp molded body is subjected to a conversion treatment with PALBOND LA35 (produced by Nihon Parkerizing Co., Ltd.) according to the manufacturer's recipe, and further to 20 μm of cation electrodeposition coating (POWERNICS 110, produced by Nipponpaint Co., Ltd.). The electrodeposition coated formed body was immersed in ion exchanged water at 50° C. for 500 hours, then a right angle lattice pattern was cut on a painted surface according to the method prescribed in JIS G3312-12.2.5 (Cross-cut adhesion test) and a tape peel test was conducted. A case in which the peeling area ratio (the number of peeled lattice cells per 100 lattice cells) in the right angle lattice pattern is 2% or less, it was denoted as a circle, 1% or less denoted as a double circle, and beyond 2% denoted as a cross mark.

The average diameter and the number of the particulate matters are measured quantitatively by the following methods. A sample is cut out from an optional position in a hot stamp molded body. After a cross-section of the cut out sample is exposed by a cross-section polisher and using a FE-SEM (Field Emission-Scanning Electron Microscope), or a cross-section of the cut out sample is exposed by a FIB (Focused Ion Beam) and using a TEM (Transmission Electron Microscope), a minimum of 10 visual fields are observed at a magnification of from 10,000 to 100,000, wherein a visual field is defined as a region of 20 μm (sheet thickness direction: the thickness direction of a steel sheet)× 100 μm (sheet width direction: the direction perpendicular to the thickness of a steel sheet). Image photographing is conducted within an observation visual field, and parts having brightness corresponding to a particulate matter are extracted by image analysis to construct a binarized image. After performing a noise removing processing on the constructed binarized image, the equivalent circle diameter of each particulate matter is measured. The measurement of an equivalent circle diameter is conducted at each of observations of 10 visual fields and the average value of equivalent circle diameters of all the particulate matters detected in the respective observation visual fields is defined as the average diameter value of particulate matters.

Meanwhile, after performing a noise removing processing on the constructed binarized image, the number of particulate matters present on an optional 1 mm-long line segment is measured. The measurement of the number is conducted at each of observations of 10 visual fields, and the average value of the numbers of particulate matters measured in the respective observation visual fields is defined as the number of particulate matters present in a plated layer per 1 mm of the plated layer length.

In this regard, the particulate matters include those present in a plated layer, at an interface between a plated layer and a steel matrix, and at an interface between a plated layer and a Zn-based oxide film. Identification of the interfaces can be made by examining the distribution of Zn, Fe, and O, when a cross-section is observed, using EDS (Energy Dispersive X-ray Spectroscopy), or an EPMA (Electron Probe Micro-Analyser), and comparing the same with a SEM observation image. In a case in which a SEM observation using reflection electrons is conducted, identification of the interfaces is easier. The particle size of an oxide is evaluated with an equivalent circle diameter by an image analysis. Component identification of a compound is conducted using energy dispersive X-ray spectroscopy (EDS) attached to a FE-SEM or a TEM.

Next, the components of a steel sheet to be used as a plating substrate will be described. In order for a steel sheet to maintain a predetermined strength after hot stamping, the following components and ranges thereof are prerequisite.

A steel sheet contains, by mass-%, C: from 0.10 to 0.35%, Si: from 0.01 to 3.00%, Al: from 0.01 to 3.00%, Mn: from 1.0 to 3.5%, P: from 0.001 to 0.100%, S: from 0.001 to 0.010%, N: from 0.0005 to 0.0100%, Ti: from 0.000 to 0.200%, Nb: from 0.000 to 0.200%, Mo: from 0.00 to 1.00%, Cr: from 0.00 to 1.00%, V: from 0.000 to 1.000%, Ni: from 0.00 to 3.00%, B: from 0.0000 to 0.0050%, Ca: from 0.0000 to 0.0050%, and Mg: from 0.0000 to 0.0050%, and a balance is Fe and impurities.

A steel sheet may contain one, or two or more kinds out of, by mass %, Ti: from 0.001 to 0.200%, Nb: from 0.001 to 0.200%, Mo: from 0.01 to 1.00%, Cr: from 0.01 to 1.00%, V: from 0.001 to 1.000%, Ni: from 0.01 to 3.00%, B: from 0.0002 to 0.0050%, Ca: from 0.0002 to 0.0050%, or Mg: from 0.0002 to 0.0050%, in addition to C: from 0.10 to 0.35%, Si: from 0.01 to 3.00%, Al: from 0.01 to 3.00%, Mn: from 1.0 to 3.5%, P: from 0.001 to 0.100%, S: from 0.001 to 0.010%, and N: from 0.0005 to 0.0100%.

Among components of a steel sheet, Ti, Nb, Mo, Cr, V, Ni, B, Ca, and Mg are optional components to be contained in a steel sheet. Namely, the components may be, or may not be, contained in a steel sheet, and therefore the lower limits of the contents include 0.

The reasons behind the respective restrictions on the contents of the component elements are as follows.

The content of C is from 0.10 to 0.35%. The content of C is set at 0.10% or more, because a sufficient strength cannot be secured below 0.10%. Meanwhile, the content of C is set at 0.35% or less, because at a carbon concentration beyond 0.35%, cementite, which can be an origin of crack generation during die cutting, increases to promote a delayed fracture. Therefore, 0.35% is defined as the upper limit. The content of C is preferably from 0.11 to 0.28%.

The content of Si is from 0.01 to 3.00%. Since Si is effective for increasing the strength as a solid solution hardening element, the higher the content is, the higher the tensile strength becomes. However, when the content of Si is beyond 3.00%, a steel sheet embrittles remarkably, and it becomes difficult to make a steel sheet; therefore, this value is defined as the upper limit. Further, since contamination with Si may be inevitable as in the case in which Si is used for deoxidation, 0.01% is defined as the lower limit. The content of Si is preferably from 0.01 to 2.00%.

The content of Al is from 0.01 to 3.00%. When the content of Al is beyond 3.00%, a steel sheet embrittles remarkably, and it becomes difficult to make a steel sheet; therefore, this value is defined as the upper limit. Further, since contamination with Al may be inevitable as in the case in which Al is used for deoxidation, 0.01% is defined as the lower limit. The content of Al is preferably from 0.05 to 1.10%.

The content of Mn is from 1.0 to 3.5%. The Mn content is set at 1.0% or more, in order to secure hardenability during hot stamping (hot pressing). Meanwhile, when the Mn content exceeds 3.5%, Mn segregation becomes likely to occur so that cracking occurs easily during hot rolling, and therefore, this value is defined as the upper limit.

The content of P is from 0.001 to 0.100%. Although P acts as a solid solution hardening element to increase the strength of a steel sheet, when the content becomes higher, the processability or weldability of a steel sheet is unfavorably compromised. Especially, when the content of P exceeds 0.100%, the deterioration of the processability or weldability of a steel sheet becomes remarkable, therefore the content of P should preferably be limited to 0.100% or less. Although there is no particularly ruled lower limit, considering dephosphorization time and cost, the content is preferably 0.001% or more.

The content of S is from 0.001 to 0.010%. When the content of Si is too high, the stretch flangeability is deteriorated and cracking during hot rolling is caused, the content should preferably be reduced to the extent possible. Especially, for preventing a crack during hot rolling and improving the processability, the S content should preferably be limited to 0.010% or less. Although there is no particularly ruled lower limit, considering desulfurization time and cost, the content is preferably 0.001% or more.

The content of N is from 0.0005 to 0.0100%. Since N decreases the absorbed energy of a steel sheet, the content is preferably as low as possible, and the upper limit is 0.0100% or less. Although there is no particularly ruled lower limit, considering denitrification time and cost, the content is preferably 0.0005% or more.

The content of Ti is from 0.000 to 0.200%, and preferably from 0.001 to 0.200%. The content of Nb is from 0.000 to 0.200%, and preferably from 0.001 to 0.200%.

Ti, and Nb are effective for reducing the crystal grain diameter. When Ti, or Nb exceeds 0.200%, the resistance to hot deformation during production of a steel sheet increases excessively, and production of a steel sheet becomes difficult, therefore this value is defined as the upper limit. Further, since Ti, and Nb are not any more effective below 0.001%, this value should preferably be defined as a lower limit.

The content of Mo is from 0.00 to 1.00%, and preferably from 0.01 to 1.00%.

Mo is an element, which improves the hardenability. When the content of Mo is beyond 1.00%, the effect is saturated, therefore this value is defined as the upper limit. Meanwhile, since below 0.01% the effect is not exhibited, this value should be preferably defined as the lower limit.

The content of Cr is from 0.00 to 1.00%, and preferably from 0.01 to 1.00%.

Cr is an element, which improves the hardenability. When the content of Cr is beyond 1.00%, Cr deteriorates a zinc-based plating property, therefore this value is defined as the upper limit. Meanwhile, since below 0.01% the hardening effect cannot be exhibited, this value should be preferably defined as the lower limit.

The content of V is from 0.000 to 1.000%, and preferably from 0.001 to 1.000%.

V is effective for reducing the crystal grain diameter. When the content of V increases, slab cracking during continuous casting is caused and production becomes difficult, and therefore 1.000% is defined as the upper limit. Meanwhile, below 0.001% the effect is not exhibited, therefore this value should be preferably defined as the lower limit.

The content of Ni is from 0.00 to 3.00%, and preferably from 0.01 to 3.00%.

Ni is an element for lowering remarkably the transformation temperature. When the content of Ni exceeds 3.00%, the cost of an alloy becomes extremely high, and therefore this value is defined as the upper limit. Meanwhile, below 0.01% the effect is not exhibited, therefore this value should be preferably defined as the lower limit. The content of Ni is more preferably from 0.02 to 1.00%.

The content of B is from 0.0000 to 0.0050%, and preferably from 0.0002 to 0.0050%.

B is an element, which improves the hardenability. Therefore, the content of B is preferably 0.0002% or more. Meanwhile, when the content is beyond 0.0050%, the effect is saturated, therefore this value is defined as the upper limit.

The content of Ca is from 0.0000 to 0.0050%, and preferably from 0.0002 to 0.0050%.

The content of Mg is from 0.0000 to 0.0050%, and preferably from 0.0002 to 0.0050%.

Ca, and Mg are elements for regulating an inclusion. When the content of Ca or Mg is below 0.0002%, the effect is not exhibited sufficiently, therefore this value should be preferably defined as the lower limit. Beyond 0.0050%, the cost of an alloy becomes extremely high, and therefore this value is defined as the upper limit.

In this regard, impurities means a component contained in a source material or a component entered in a process of production, which is a component not intentionally added to a steel sheet.

Next, a method for producing a hot stamp molded body according to the invention will be described.

A method for producing a hot stamp molded body according to the invention is a method, by which a steel containing the aforedescribed components is subjected to a hot rolling step, a pickling step, a cold rolling step, a continuous annealing step, a temper rolling step, and an electrogalvanizing step to yield an electrogalvanized steel sheet, and the electrogalvanized steel sheet is subjected to a hot stamp molding step to produce a hot stamp molded body.

Specifically, for example, a steel containing the aforedescribed components is made to a certain hot-rolled steel sheet in the hot rolling step in the usual manner, scale is removed in the pickling step before cold rolling, and then rolled to a predetermined sheet thickness in the cold rolling step. Thereafter, the cold-rolled sheet is annealed in the continuous annealing step, and rolled at an extension rate of from approx. 0.4% to 3.0% in the temper rolling step. Next, the obtained steel sheet is plated to a predetermined plating weight in the electrogalvanizing step to complete an electrogalvanized steel sheet. Then the electrogalvanized steel sheet is molded to a predetermined shape in the hot stamp molding step. Through the above process, a hot stamp molded body is produced.

The continuous annealing step will be described.

In the continuous annealing step, annealing for recrystallization and obtaining a predetermined material quality is conducted. It is in this continuous annealing step that an oxide, etc., which is an origin of a particulate matter to be formed in a plated layer later, is prepared at an interface between plating and a steel matrix, or inside a steel matrix.

Generally, in a continuous annealing step a steel sheet is heated in a mix gas containing $N_2$ and $H_2$ as main components to avoid oxidation of Fe in the surface. However, with respect to an easily oxidizable element added in a steel sheet, the equilibrium oxygen potential of element/oxide is so low, even in such an atmosphere a part of the same near the surface is oxidized selectively, and therefore an oxide of the element is present in the surface of a steel sheet and inside a steel sheet after annealing.

With respect to a technique for forming an oxide moderately inside a steel sheet, the inventors have focused on a continuous annealing step where an oxide is formed, to learn that by applying a strain to a steel sheet by at least 4 cycles of repeated bending of a steel sheet during heating up to a soaking sheet temperature for recrystallization or securing a material quality and within a sheet temperature range of from 350° C. to 700° C., an oxide can be formed inside a steel sheet in a proper amount and shape. This is conceivably because a part of an oxide is formed inside steel due to promotion of inward diffusion of oxygen into steel by application of a strain to a steel sheet surface by repeated bending, while oxidation of an easily oxidizable element is progressing.

With respect to an atmosphere gas condition in a furnace, an ordinarily used atmosphere gas is used, specifically, an atmosphere gas containing hydrogen at from 0.1 volume % to 30 volume %, $H_2O$ (water vapor) correspond to a dew point of from −70° C. to −20° C., and nitrogen and impurities as a balance. In this regard, impurities in an atmosphere gas means a component contained in a source material or a component entered in a process of production, which is a component not intentionally added to an atmosphere gas.

When the hydrogen concentration is less than 0.1 volume %, a Fe-based oxidized film present on a steel sheet surface cannot be reduced thoroughly and therefore the plating wettability cannot be secured. Consequently, the hydrogen concentration of a reducing atmosphere for annealing should be 0.1 volume % or more. Further, when the hydrogen concentration exceeds 30 volume % the oxygen potential in an atmosphere gas becomes low, and it becomes difficult to form a certain amount of an oxide of an easily oxidizable element. Therefore, the hydrogen concentration of a reducing atmosphere for annealing should be 30 volume % or less.

The dew point should be from −70° C. to −20° C. Less than −70° C., it becomes difficult to secure an oxygen potential necessary for internal oxidation of an easily oxidizable element, such as Si, and Mn, inside steel. Meanwhile, when it exceeds −20° C., a Fe-based oxidized film cannot be reduced thoroughly, and the plating wettability cannot be secured.

In this regard, the hydrogen concentration and the dew point in an atmosphere are measured by monitoring continuously an atmosphere gas in an annealing furnace with a hydrogen densitometer or a dew point meter.

When a steel sheet is annealed in the atmosphere gas, a temperature region, within which repeated bending is rendered to a steel sheet, is from 350° C. to 700° C. Since oxidation of an easily oxidizable element in a steel sheet progresses significantly at a high temperature of 350° C. or more, even when repeated bending is rendered at a temperature region below 350° C., it has no effect on oxidation. It is presumed that, by applying a strain due to repeated bending to a steel sheet surface in a temperature region where the oxidation phenomenon occurs significantly, inward diffusion of oxygen into the steel sheet is promoted and an oxide is formed inside the steel sheet.

Meanwhile, when a steel sheet is heated exceeding 700° C., recrystallization and grain growth in a steel sheet tissue advance. Therefore, for micronizing the tissue of a steel sheet surface by forming an oxide inside the steel sheet, it is necessary to apply a strain by rendering repeated bending to a steel sheet within a temperature region of from 350° C. to 700° C.

Figure 6A:
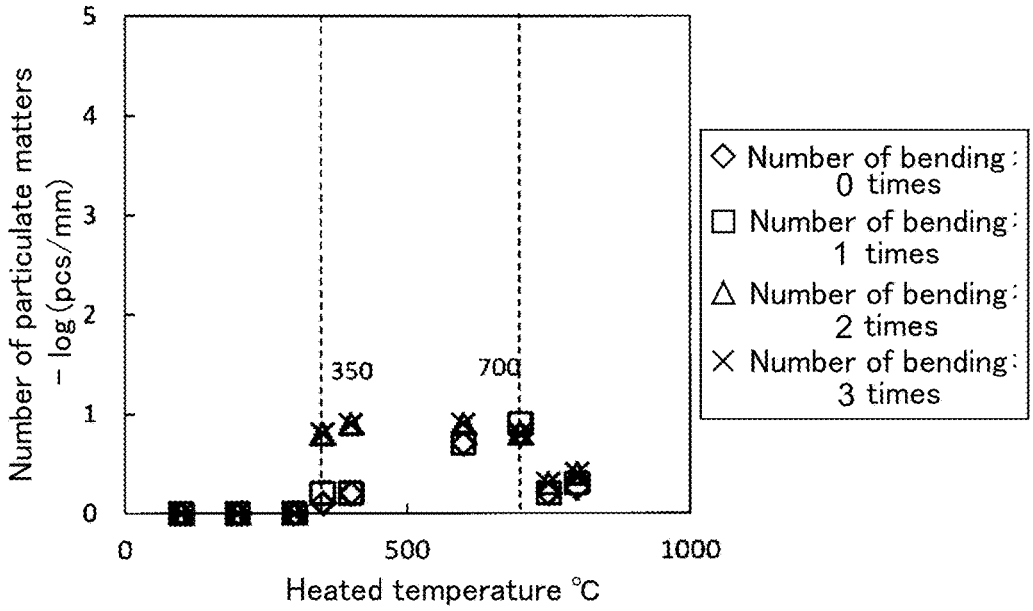
FIG. 6A is a graph showing a relationship between the number of 90° bending during heating and the formation amount of an oxide inside a steel sheet, with respect to the number of bending of 0, 1, 2, and 3 times.
Figure 6B:
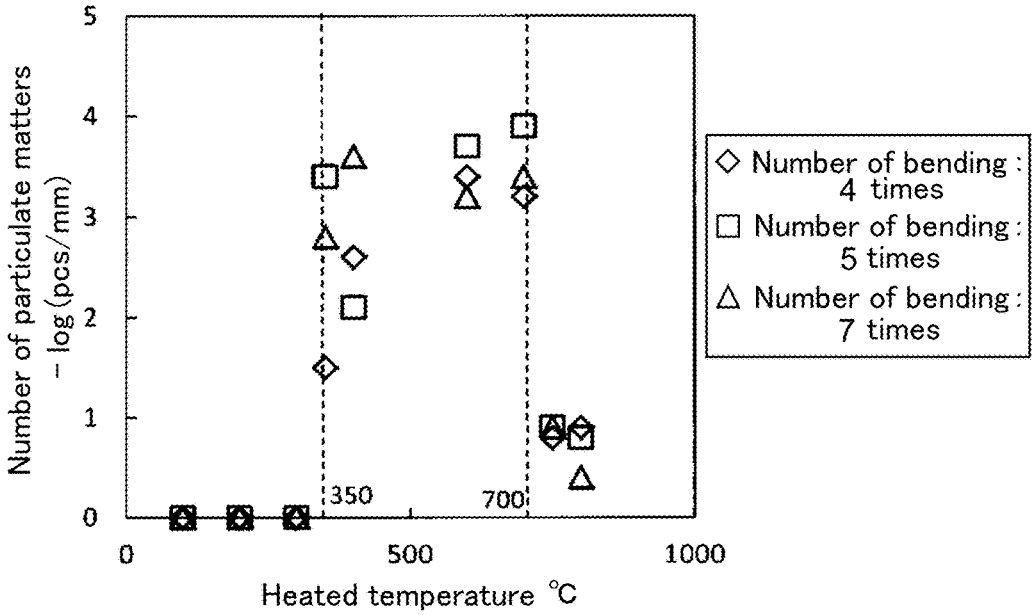
FIG. 6B is a graph showing a relationship between the number of 90° bending during heating and the formation amount of an oxide inside a steel sheet, with respect to the number of bending of 4, 5, and 7 times.
Figure 6C:
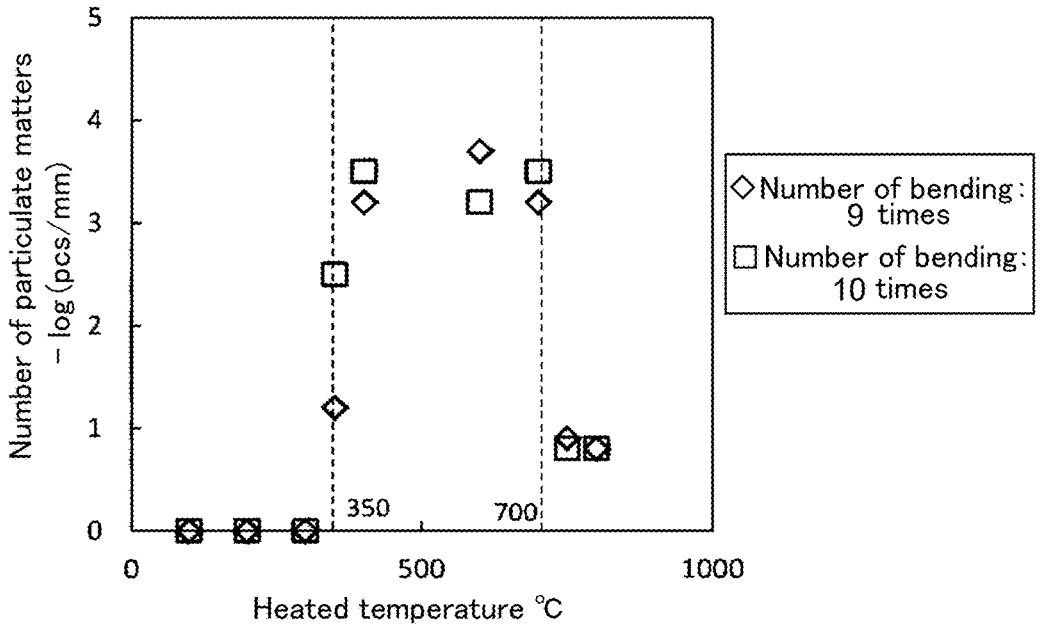
FIG. 6C is a graph showing a relationship between the number of 90° bending during heating and the formation amount of an oxide inside a steel sheet, with respect to the number of bending of 9, and 10 times.

The results of an investigation on the formation amount of an oxide inside a steel sheet, when a steel sheet containing C: 0.20%, Si: 0.15%, and Mn: 2.0% was subjected to bending of 90° in a designated number in a condition heated at a constant temperature, are shown in FIG. 6A to FIG. 6C. The above was carried out in a condition that the atmosphere in a furnace during heating was a mix atmosphere of 5% $H_2$ and $N_2$, and the dew point was regulated at −40° C. The retention time was 3 min. It is obvious that, in a case in which a steel sheet is heated to 350° C. or more, and the bending number is 4 times or more, the formation amount of an oxide inside a steel sheet increases.

For confirmation of whether or not the number of repeated bending is carried out within a predetermined temperature range in a predetermined number, and for regulation thereto, it is preferable to measure the temperature of a steel sheet in an annealing furnace by installing a radiation thermometer or a contact-type thermometer in the furnace. However, from a restriction of equipment, it is not practical, although not impossible. Therefore, in a case in which the temperature of a steel sheet cannot measured directly, the structure in a furnace, the input heat quantity, the circulation of a furnace gas, the size of a steel sheet to be supplied, the line speed, the temperature in a furnace, and an actual or target temperature of the entrance and exit of a furnace and/or a sheet are utilized. From a on-line prediction result, or a off-line preceding calculation result based on the above conditions using a heat transfer simulation by a computer or a simplified heat-transfer calculation, the number of repeated bending when the sheet temperature is within the range of from 350° C. to 700° C. is identified. If necessary, the input heat quantity, the line speed, etc. should preferably be regulated. In this regard, the heat transfer simulation or simplified heat-transfer calculation may be those used regularly by persons skilled in the art, for example, a simplified heat transfer equation, or a computer simulation, insofar as the same comply with the heat transfer theory.

Since there is almost no effect when the number of repeated bending is 3 times or less, at least 4 times are required. As for the upper limit of the number of repeated bending, according to FIG. 6A to FIG. 6C, the effects are more or less identical between 4 times and 10 times, although there is some fluctuation, and therefore, no upper limit has been particularly defined. However, if the number exceeds 10 times, the furnace facility may become considerably larger and longer compared to a usual one, and therefore, the upper limit is preferably 10 times from a viewpoint of facility constraint. So long as there is no facility constraint, the number may be 10 times or more.

Figure 7:
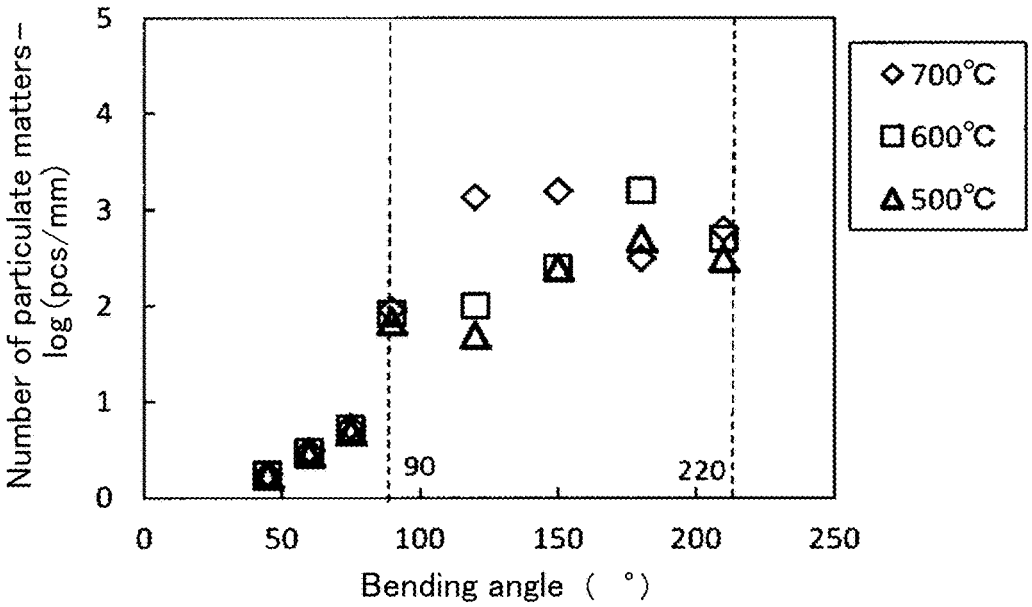
FIG. 7 is a graph showing a relationship between the bending angle inflicted on a sample during heating and the formation amount of an oxide inside a steel sheet.

The angle of the subject repeated bending is decided at from 90° to 220° according to FIG. 7. In the case of less than 90°, an effect of bending cannot be obtained sufficiently. Although there is no particular ruled upper limit, an angle beyond 220° is difficult because of an arrangement of rolls and a path line in a furnace, 220° is deemed as the upper limit. In this regard, the angle of bending means an angle made by the longitudinal direction of a steel sheet before bending and the longitudinal direction of a steel sheet after bending. Although there is no particular rules for a technique for bending a steel sheet, in the case of a continuous annealing line, bending in the longitudinal direction is possible with hearth rolls in a furnace. In this case, the bending angle correspond to a contact angle with the hearth rolls.

With respect to the number of repeated bending of a steel sheet, a pair of bends of both surfaces of a steel sheet in one direction is counted as 1 time. In a case in which bends of a steel sheet in the same direction occur 2 times or more successively, the successive bends are counted as 1 time. Further, in a case in which bends of a steel sheet with a bending angle of less than 90° C. occur 2 times or more successively in the same direction, and the total of the bending angles becomes between 90° and 220°, the successive bends are counted as 1 time.

FIG. 7 is the results of investigations on the formation amount of an oxide inside a steel sheet, which contained C: 0.20%, Si: 0.15%, and Mn: 2.0%, and was subjected to bending 4 times at a different bending angle in a condition where the steel sheet was heated at a certain temperature, the atmosphere in a furnace during heating was a mix atmosphere of 5% $H_2$ and $N_2$, and the dew point was controlled at −40° C. The retention time was 3 min.

Next, the electrogalvanizing step will be described.

In the electrogalvanizing step, each surface of a steel sheet is coated with zinc-based plating of not less than 5 g/m$^2$ and less than 40 g/m$^2$. Although either of electric zinc plating, and electric zinc alloy plating may be applied as a method for coating a plated layer, insofar as a plated layer with a plating weight of not less than 5 g/m$^2$ and less than 40 g/m$^2$ for each surface can be secured, electric zinc alloy plating are preferable for securing stably a predetermined plating weight in the width direction, as well as in the sheet passing direction. In this regard, the electric zinc alloy plating electrodeposits, together with Zn, elements such as Fe, Ni, Co, Cr or the like corresponding to an intended object in the electrical plating step, and forms an alloy composed of Zn and these elements as a plated layer.

There is no particular restriction on the composition of a plated layer, and insofar zinc occupies 70% or more by mass %, and the zinc alloy plated layer may contain as a balance components the alloy elements, such as Fe, Ni, Co, and Cr, corresponding to an intended object. Further, some of Al, Mn, Mg, Sn, Pb, Be, B, Si, P, S, Ti, V, W, Mo, Sb, Cd, Nb, Cr, Sr, etc., which may be inevitably mixed from a source material, etc., may be included. Although some of them overlap alloy elements for electric zinc alloy plating, an element with the content of less than 0.1% is deemed as impurities.

Next, the hot stamp molding step will be described.

In the hot stamp molding step, an electrogalvanized steel sheet, which temperature is elevated at an average temperature elevation rate of 50° C./sec or more to a temperature range of from 700° C. to 1100° C., is hot-stamped within the time of 1 min from the initiation of temperature elevation to hot stamping, and then cooled down to normal temperature.

Specifically, an electrogalvanized steel sheet is heated for hot stamping at an average temperature elevation rate of 50° C./sec or more by Joule heating, induction heating, etc. By this heating, the temperature of the steel sheet is raised to a temperature range of from 700° C. to 1100° C. When the steel sheet is heated to a predetermined temperature, retained there for a certain time period, and then cooled at a predetermined cooling rate. After cooled down to a predetermined temperature, hot stamping is carried out within 1 min or less from the initiation of temperature elevation of the steel sheet. In other words, hot stamping is conducted such that the total time of the temperature elevation time, the cooling time, and the retention time is 1 min or less.

By conducting the hot stamp molding step under the above conditions on an electrogalvanized steel sheet having undergone the continuous annealing step, and the electrogalvanizing step, the remaining amount of a Zn—Fe intermetallic compound in a plated layer of the hot stamp molded body can be reduced to a range of from 0 $g/m^2$ to 15 $g/m^2$. Further, by heating for hot stamping in the hot stamp molding step, particulate matters with an average diameter of from 10 nm to 1 μm can be formed in a plated layer at $1\times10$ to $1\times10^4$ pcs per 1 mm of the plated layer length.

EXAMPLES

Examples of the invention will be presented below.

Steels with the components shown in Table 1 were subjected to hot rolling, pickling, and cold rolling in the usual manner to yield steel sheets (raw sheets) of steel grades A to T. Next, the yielded steel sheets were annealed continuously. The continuous annealing was conducted in an atmosphere gas containing hydrogen at 10 weight %, and water vapor corresponding to a dew point of −40° C., as well as nitrogen and impurities as a balance, and under a condition of 800° C.×100 sec. At the continuous annealing, repeated bending on a steel sheet by rolls was conducted in a number shown in Table 2 during heating and at a sheet temperature within the range of from 350° C. to 700° C. The repeated bending of a steel sheet was conducted at a bending angle shown in Table 2 and Table 3 toward different directions from the sheet face alternatingly. In this regard, repeated bending of a steel sheet in multiple times was totally conducted at a bending angle shown in Table 2 and Table 3. Thereafter, a steel sheet annealed continuously was cooled down to normal temperature and subjected to temper rolling at an extension rate of 1.0%.

Next, a steel sheet having undergone the continuous annealing and the temper rolling was subjected to electrogalvanization of the kind of plating at a plating weight on each surface shown in Table 2 and Table 3 to obtain an electrogalvanized steel sheet. The components, plating weight, and Zn amount in a plated layer of the steel sheet were examined with an ICP emission analyzer on a solution prepared by dissolving the plated layer with a 10% HCl solution containing an inhibitor.

Next, the electrogalvanized steel sheet was subjected to hot stamp molding under a condition shown in Table 2 and Table 3. Specifically a steel sheet was heated at an average temperature elevation rate set forth in Tables 2 and 3 using induction heating. After a steel sheet reached a temperature set forth in Tables 2 and 3, the same was kept there for a retention time shown in Table 2 and Table 3. Then cooling at 20° C./s, the steel sheet was hot-stamped at 680° C. In this regard, the hot stamping was conducted such that the required time from the initiation of temperature elevation (initiation of heating) to the hot stamping (time period from the initiation of the heating to the hot stamping) became the time shown in Table 2 and Table 3.

Through the process, hot stamp molded bodies having different tissues and structures in plated layers after hot stamp molding were produced.

A sample was cut out from a produced hot stamp molded body, and the amount of a Zn—Fe intermetallic compound per unit area of a plated layer was measured by the above measuring method.

Further, a cross-section of the sample was observed to determine the average diameter of particulate matters in a plated layer and the number of particulate matters per 1 mm of the plated layer by the above measuring methods. The observation of a cross-section of the sample was conducted at a magnification of 50,000 using a FE-SEM/EDS. In this regard, particulate matters present in a plated layer in the thus conducted test were particles of MnO, $Mn_2SiO_4$, and $(Mn,Cr)_3O_4$.

Further, after hot press molding, 10 points were selected at random on press surfaces of a press mold, where a substance stuck to the mold was peeled with a cellophane adhesive tape, and identified using a SEM/EDS to examine whether a Zn—Fe intermetallic compound had stuck to the mold or not.

Further, on the obtained hot press formed body, the paint adhesiveness test was carried out. A case in which the peeling area ratio (the number of peeled lattice cells per 100 lattice cells) in the right angle lattice pattern is 2% or less, it was denoted as A, 1% or less denoted as AA, and beyond 2% denoted as C.

The product satisfying the requirements of the invention does not show sticking of the plating to a mold, nor formation of a Fe scale, and is superior in paint adhesiveness.

The details of Examples and the evaluation results are summarized in Table 1 to Table 5.

TABLE 1

| Steel grade | C | Si | Mn | P | S | Al | N | Other select element |
|---|---|---|---|---|---|---|---|---|
| A | 0.22 | 0.15 | 2.0 | 0.01 | 0.005 | 0.05 | 0.002 | |
| B | 0.18 | 0.01 | 1.0 | 0.01 | 0.007 | 0.08 | 0.002 | |
| C | 0.19 | 0.30 | 2.5 | 0.01 | 0.003 | 0.06 | 0.002 | |
| D | 0.11 | 2.00 | 3.5 | 0.01 | 0.008 | 0.05 | 0.002 | |
| E | 0.28 | 1.50 | 2.5 | 0.01 | 0.005 | 1.10 | 0.002 | |
| F | 0.25 | 1.50 | 3.0 | 0.01 | 0.004 | 0.58 | 0.002 | |
| G | 0.20 | 0.15 | 1.5 | 0.01 | 0.004 | 0.06 | 0.002 | Cr: 0.20 |
| H | 0.20 | 0.15 | 1.5 | 0.01 | 0.004 | 0.06 | 0.002 | B: 0.0010 |
| I | 0.20 | 0.15 | 1.5 | 0.01 | 0.004 | 0.06 | 0.002 | Ti: 0.100 |
| J | 0.20 | 0.15 | 1.5 | 0.01 | 0.005 | 0.05 | 0.002 | V: 0.300 |
| K | 0.20 | 0.15 | 1.5 | 0.01 | 0.005 | 0.05 | 0.002 | Mo: 0.10 |
| L | 0.20 | 0.15 | 1.5 | 0.01 | 0.005 | 0.05 | 0.002 | Cr: 0.30, B: 0.0010 |
| M | 0.20 | 0.15 | 1.5 | 0.01 | 0.005 | 0.05 | 0.002 | Ti: 0.010, B: 0.0010 |
| N | 0.20 | 0.15 | 1.5 | 0.01 | 0.005 | 0.05 | 0.002 | V: 0.200, Mo: 0.05 |

TABLE 1-continued

| Steel grade | C | Si | Mn | P | S | Al | N | Other select element |
|---|---|---|---|---|---|---|---|---|
| O | 0.20 | 0.15 | 1.5 | 0.01 | 0.005 | 0.05 | 0.002 | Ni: 0.30, Nb: 0.050 |
| P | 0.20 | 0.15 | 1.5 | 0.01 | 0.005 | 0.05 | 0.002 | Ca: 0.0030, Mg: 0.0050 |
| Q | 0.20 | 0.15 | 1.5 | 0.01 | 0.005 | 0.05 | 0.002 | Cr: 0.30, B: 0.0010, Mo: 0.01 |
| R | 0.20 | 0.15 | 1.5 | 0.01 | 0.005 | 0.05 | 0.002 | Ti: 0.010, B: 0.0010, Mo: 0.01 |
| S | 0.20 | 0.15 | 1.5 | 0.01 | 0.005 | 0.05 | 0.002 | Ca: 0.0010, B: 0.0010, Mg: 0.0010 |
| T | 0.20 | 0.15 | 1.5 | 0.01 | 0.005 | 0.05 | 0.002 | Ni: 0.30, Ti: 0.005, Nb: 0.005 |

TABLE 2

| | | Continuous annealing Repeated bending within the range of 350 to 700° C. | | Electrogalvanized coating | | | Hot stamp molding | | | |
|---|---|---|---|---|---|---|---|---|---|---|
| Test No. | Steel grade | Repeated number (times) | Bending angle (°) | Plating kind | Stuck plating amount (g/m$^2$) | Zn amount (g/m$^2$) | Average temperature elevation rate (° C./s) | Maximum heated temperature (° C.) | Retention time (s) | Required time from initiation of temperature elevation until hot stamping (s) |
| 1 | A | 5 | 150 | Electric Zn plating | 20 | 20 | 80 | 900 | 10 | 32 |
| 2 | A | 4 | 150 | Electric Zn plating | 19 | 19 | 80 | 900 | 0 | 22 |
| 3 | A | 7 | 90 | Electric Zn plating | 21 | 21 | 80 | 840 | 20 | 38 |
| 4 | A | 6 | 150 | Electric Zn plating | 7 | 7 | 80 | 840 | 1 | 19 |
| 5 | A | 8 | 220 | Electric Zn plating | 28 | 28 | 80 | 1050 | 2 | 33 |
| 6 | A | 9 | 150 | Electric Zn plating | 38 | 38 | 80 | 1050 | 20 | 51 |
| 7 | A | 8 | 150 | Electric Zn plating | 20 | 20 | 80 | 900 | 0 | 22 |
| 8 | A | 6 | 150 | Electric Zn plating | 21 | 21 | 80 | 900 | 0 | 22 |
| 9 | A | 4 | 150 | Electric Zn plating | 20 | 20 | 80 | 900 | 0 | 22 |
| 10 | A | 10 | 150 | Electric Zn plating | 20 | 20 | 80 | 900 | 0 | 22 |
| 11 | B | 5 | 150 | Electric Zn plating | 20 | 20 | 80 | 900 | 10 | 32 |
| 12 | B | 4 | 150 | Electric Zn plating | 19 | 19 | 80 | 900 | 0 | 22 |
| 13 | B | 7 | 90 | Electric Zn plating | 21 | 21 | 80 | 840 | 20 | 38 |
| 14 | B | 6 | 150 | Electric Zn plating | 7 | 7 | 80 | 840 | 1 | 19 |
| 15 | B | 8 | 220 | Electric Zn plating | 28 | 28 | 80 | 1050 | 2 | 33 |
| 16 | B | 9 | 150 | Electric Zn plating | 38 | 38 | 80 | 1050 | 20 | 51 |
| 17 | B | 8 | 150 | Electric Zn plating | 20 | 20 | 80 | 900 | 0 | 22 |
| 18 | B | 6 | 150 | Electric Zn plating | 21 | 21 | 80 | 900 | 0 | 22 |
| 19 | B | 4 | 150 | Electric Zn plating | 20 | 20 | 80 | 900 | 0 | 22 |
| 20 | B | 10 | 150 | Electric Zn plating | 20 | 20 | 80 | 900 | 0 | 22 |
| 21 | C | 5 | 150 | Electric Zn plating | 20 | 20 | 80 | 900 | 10 | 32 |
| 22 | C | 4 | 90 | Electric Zn plating | 19 | 19 | 80 | 900 | 0 | 22 |
| 23 | C | 7 | 150 | Electric Zn plating | 21 | 21 | 80 | 840 | 20 | 38 |
| 24 | C | 6 | 220 | Electric Zn plating | 7 | 7 | 80 | 840 | 1 | 19 |
| 25 | C | 8 | 150 | Electric Zn plating | 28 | 28 | 80 | 1050 | 2 | 33 |
| 26 | C | 9 | 150 | Electric Zn plating | 38 | 38 | 80 | 1050 | 20 | 51 |
| 27 | C | 8 | 150 | Electric Zn plating | 20 | 20 | 80 | 900 | 0 | 22 |
| 28 | C | 6 | 150 | Electric Zn plating | 21 | 21 | 80 | 900 | 0 | 22 |
| 29 | C | 4 | 150 | Electric Zn plating | 20 | 20 | 80 | 900 | 0 | 22 |
| 30 | C | 10 | 150 | Electric Zn plating | 20 | 20 | 80 | 900 | 0 | 22 |
| 31 | D | 5 | 150 | Electric Zn plating | 20 | 20 | 80 | 900 | 10 | 32 |
| 32 | E | 4 | 150 | Electric Zn plating | 19 | 19 | 80 | 900 | 0 | 22 |
| 33 | F | 7 | 150 | Electric Zn plating | 21 | 21 | 80 | 840 | 20 | 38 |
| 34 | G | 6 | 150 | Electric Zn plating | 7 | 7 | 80 | 840 | 1 | 19 |
| 35 | H | 8 | 150 | Electric Zn plating | 28 | 28 | 80 | 1050 | 2 | 33 |
| 36 | I | 9 | 150 | Electric Zn plating | 38 | 38 | 80 | 1050 | 20 | 51 |
| 37 | J | 5 | 150 | Electric Zn plating | 25 | 25 | 80 | 900 | 2 | 24 |
| 38 | K | 9 | 150 | Electric Zn plating | 38 | 38 | 80 | 1050 | 20 | 51 |
| 39 | L | 8 | 150 | Electric Zn plating | 20 | 20 | 80 | 900 | 0 | 22 |
| 40 | M | 4 | 150 | Electric Zn plating | 19 | 19 | 80 | 900 | 0 | 22 |

TABLE 3

| Test No. | Steel grade | Continuous annealing Repeated bending within the range of 350 to 700° C. Repeated number (times) | Bending angle (°) | Electrogalvanized coating Plating kind | Stuck plating amount (g/m$^2$) | Zn amount (g/m$^2$) | Hot stamp molding Average temperature elevation rate (° C./s) | Maximum heated temperature (° C.) | Retention time (s) | Required time from initiation of temperature elevation until hot stamping (s) |
|---|---|---|---|---|---|---|---|---|---|---|
| 41 | N | 6 | 150 | Electric Zn plating | 7 | 7 | 80 | 840 | 1 | 19 |
| 42 | O | 6 | 150 | Electric Zn plating | 21 | 21 | 80 | 900 | 0 | 22 |
| 43 | P | 10 | 150 | Electric Zn plating | 20 | 20 | 80 | 900 | 0 | 22 |
| 44 | Q | 4 | 150 | Electric Zn plating | 20 | 20 | 80 | 900 | 0 | 22 |
| 45 | R | 5 | 150 | Electric Zn plating | 20 | 20 | 80 | 900 | 10 | 32 |
| 46 | S | 4 | 150 | Electric Zn plating | 19 | 19 | 80 | 900 | 0 | 22 |
| 47 | T | 9 | 150 | Electric Zn plating | 38 | 38 | 80 | 1050 | 20 | 51 |
| 48 | A | 5 | 150 | Electric Zn—10% Fe plating | 20 | 18 | 80 | 900 | 10 | 32 |
| 49 | A | 4 | 150 | Electric Zn—10% Fe plating | 19 | 17 | 80 | 900 | 0 | 22 |
| 50 | A | 7 | 150 | Electric Zn—10% Fe plating | 21 | 19 | 80 | 840 | 20 | 38 |
| 51 | A | 6 | 150 | Electric Zn—10% Fe plating | 7 | 6 | 80 | 840 | 1 | 19 |
| 52 | A | 8 | 150 | Electric Zn—10% Fe plating | 28 | 25 | 80 | 1050 | 2 | 33 |
| 53 | A | 9 | 150 | Electric Zn—10% Fe plating | 38 | 34 | 80 | 1050 | 20 | 51 |
| 54 | A | 8 | 150 | Electric Zn—10% Fe plating | 20 | 18 | 80 | 900 | 0 | 22 |
| 55 | A | 6 | 150 | Electric Zn—10% Fe plating | 21 | 19 | 80 | 900 | 0 | 22 |
| 56 | A | 4 | 150 | Electric Zn—10% Fe plating | 20 | 18 | 80 | 900 | 0 | 22 |
| 57 | A | 10 | 150 | Electric Zn—10% Fe plating | 20 | 18 | 80 | 900 | 0 | 22 |
| 58 | A | 5 | 150 | Electric Zn—10% Ni plating | 20 | 18 | 80 | 900 | 10 | 32 |
| 59 | A | 4 | 150 | Electric Zn—10% Ni plating | 19 | 17 | 80 | 900 | 0 | 22 |
| 60 | A | 7 | 150 | Electric Zn—10% Ni plating | 21 | 19 | 80 | 840 | 20 | 38 |
| 61 | A | 6 | 150 | Electric Zn—10% Ni plating | 7 | 6 | 80 | 840 | 1 | 19 |
| 62 | A | 8 | 150 | Electric Zn—10% Ni plating | 28 | 25 | 80 | 1050 | 2 | 33 |
| 63 | A | 9 | 150 | Electric Zn—10% Ni plating | 38 | 34 | 80 | 1050 | 20 | 51 |
| 64 | A | 8 | 150 | Electric Zn—10% Ni plating | 20 | 18 | 80 | 900 | 0 | 22 |
| 65 | A | 6 | 150 | Electric Zn—10% Ni plating | 21 | 19 | 80 | 900 | 0 | 22 |
| 66 | A | 4 | 150 | Electric Zn—10% Ni plating | 20 | 18 | 80 | 900 | 0 | 22 |
| 67 | A | 10 | 150 | Electric Zn—10% Ni plating | 20 | 18 | 80 | 900 | 0 | 22 |
| 68 | A | 5 | 150 | Electric Zn plating | 51 | 51 | 80 | 1000 | 20 | 48 |
| 69 | A | 4 | 150 | Electric Zn plating | 2 | 2 | 80 | 800 | 0 | 16 |
| 70 | A | 1 | 150 | Electric Zn plating | 20 | 20 | 80 | 900 | 0 | 22 |
| 71 | A | 0 | — | Electric Zn plating | 20 | 20 | 80 | 900 | 0 | 22 |
| 72 | A | 3 | 150 | Electric Zn plating | 20 | 20 | 80 | 800 | 0 | 16 |
| 73 | A | 3 | 150 | Electric Zn plating | 19 | 19 | 80 | 900 | 0 | 22 |
| 74 | A | 5 | 150 | Electric Zn plating | 35 | 35 | 80 | 750 | 0 | 13 |

TABLE 4

| Test Number | Steel grade | Plated layer of hot press formed body Amount of Zn—Fe intermetallic compound (g/m$^2$) | Average diameter of particulate matter (nm) | Number of particulate matter log (pcs/mm) | Evaluation Plating stuck to mold Existent or not | Formation of Fe scale Existent or not | Painting adhesiveness | Remarks |
|---|---|---|---|---|---|---|---|---|
| 1 | A | 0.0 | 18 | 1.6 | No | No | AA | Example |
| 2 | A | 0.0 | 18 | 2.5 | No | No | AA | Example |
| 3 | A | 1.5 | 23 | 3.2 | No | No | AA | Example |
| 4 | A | 5.0 | 22 | 2.6 | No | No | AA | Example |

TABLE 4-continued

| Test Number | Steel grade | Plated layer of hot press formed body: Amount of Zn—Fe intermetallic compound (g/m$^2$) | Average diameter of particulate matter (nm) | Number of particulate matter log (pcs/mm) | Evaluation: Plating stuck to mold Existent or not | Formation of Fe scale Existent or not | Painting adhesiveness | Remarks |
|---|---|---|---|---|---|---|---|---|
| 5 | A | 0.0 | 24 | 3.3 | No | No | AA | Example |
| 6 | A | 3.8 | 28 | 3.6 | No | No | A | Example |
| 7 | A | 0.0 | 22 | 3.8 | No | No | A | Example |
| 8 | A | 0.0 | 19 | 1.6 | No | No | AA | Example |
| 9 | A | 0.0 | 13 | 1.2 | No | No | AA | Example |
| 10 | A | 0.0 | 26 | 3.7 | No | No | A | Example |
| 11 | B | 0.0 | 16 | 1.5 | No | No | AA | Example |
| 12 | B | 0.0 | 15 | 2.3 | No | No | AA | Example |
| 13 | B | 3.5 | 21 | 2.6 | No | No | AA | Example |
| 14 | B | 5.6 | 18 | 2.4 | No | No | AA | Example |
| 15 | B | 0.0 | 19 | 3.2 | No | No | AA | Example |
| 16 | B | 6.9 | 22 | 3.6 | No | No | AA | Example |
| 17 | B | 0.0 | 19 | 3.6 | No | No | AA | Example |
| 18 | B | 0.0 | 26 | 1.2 | No | No | AA | Example |
| 19 | B | 0.0 | 11 | 1.1 | No | No | A | Example |
| 20 | B | 0.0 | 21 | 2.7 | No | No | AA | Example |
| 21 | C | 0.0 | 22 | 2.4 | No | No | AA | Example |
| 22 | C | 0.0 | 24 | 3.1 | No | No | AA | Example |
| 23 | C | 1.4 | 28 | 3.1 | No | No | AA | Example |
| 24 | C | 3.2 | 25 | 3.2 | No | No | AA | Example |
| 25 | C | 0.0 | 28 | 3.2 | No | No | AA | Example |
| 26 | C | 5.3 | 37 | 3.8 | No | No | A | Example |
| 27 | C | 0.0 | 28 | 3.7 | No | No | A | Example |
| 28 | C | 0.0 | 27 | 2.5 | No | No | AA | Example |
| 29 | C | 0.0 | 20 | 1.9 | No | No | AA | Example |
| 30 | C | 0.0 | 25 | 3.8 | No | No | A | Example |
| 31 | D | 0.0 | 19 | 2 | No | No | AA | Example |
| 32 | E | 0.0 | 18 | 2.1 | No | No | AA | Example |
| 33 | F | 2.2 | 23 | 2.7 | No | No | AA | Example |
| 34 | G | 4.5 | 24 | 3.8 | No | No | AA | Example |
| 35 | H | 0.0 | 25 | 2.4 | No | No | AA | Example |
| 36 | I | 0.0 | 27 | 3.6 | No | No | A | Example |
| 37 | J | 0.0 | 16 | 2.5 | No | No | AA | Example |
| 38 | K | 0.0 | 27 | 3.6 | No | No | A | Example |
| 39 | L | 0.0 | 22 | 3.6 | No | No | A | Example |
| 40 | M | 0.0 | 15 | 2.3 | No | No | AA | Example |

TABLE 5

| Test Number | Steel grade | Plated layer of hot press formed body: Amount of Zn—Fe intermetallic compound (g/m$^2$) | Average diameter of particulate matter (nm) | Number of particulate matter log (pcs/mm) | Evaluation: Plating stuck to mold Existent or not | Formation of Fe scale Existent or not | Painting adhesiveness | Remarks |
|---|---|---|---|---|---|---|---|---|
| 41 | N | 3.5 | 25 | 3.2 | No | No | AA | Example |
| 42 | O | 0.0 | 27 | 2.3 | No | No | AA | Example |
| 43 | P | 0.0 | 26 | 3.8 | No | No | A | Example |
| 44 | Q | 0.0 | 20 | 1.7 | No | No | AA | Example |
| 45 | R | 0.0 | 16 | 1.6 | No | No | AA | Example |
| 46 | S | 0.0 | 18 | 2.2 | No | No | AA | Example |
| 47 | T | 6.9 | 22 | 3.1 | No | No | A | Example |
| 48 | A | 0.0 | 18 | 2 | No | No | AA | Example |
| 49 | A | 0.0 | 18 | 2.2 | No | No | AA | Example |
| 50 | A | 1.4 | 23 | 2.8 | No | No | AA | Example |
| 51 | A | 5.1 | 22 | 2.4 | No | No | AA | Example |
| 52 | A | 0.0 | 24 | 3.2 | No | No | AA | Example |
| 53 | A | 3.4 | 28 | 3.7 | No | No | A | Example |
| 54 | A | 0.0 | 22 | 3.8 | No | No | A | Example |
| 55 | A | 0.0 | 19 | 1.7 | No | No | AA | Example |
| 56 | A | 0.0 | 13 | 1.6 | No | No | AA | Example |
| 57 | A | 0.0 | 26 | 3.8 | No | No | A | Example |
| 58 | A | 0.0 | 16 | 1.5 | No | No | AA | Example |
| 59 | A | 0.0 | 15 | 2.4 | No | No | AA | Example |
| 60 | A | 2.3 | 21 | 2.6 | No | No | AA | Example |
| 61 | A | 4.3 | 18 | 2.4 | No | No | AA | Example |
| 62 | A | 0.0 | 19 | 3.1 | No | No | AA | Example |
| 63 | A | 4.7 | 22 | 3.7 | No | No | AA | Example |
| 64 | A | 0.0 | 19 | 3.6 | No | No | AA | Example |
| 65 | A | 0.0 | 26 | 1.2 | No | No | AA | Example |
| 66 | A | 0.0 | 11 | 1.1 | No | No | A | Example |

TABLE 5-continued

| | | Plated layer of hot press formed body | | | Evaluation | | | |
|---|---|---|---|---|---|---|---|---|
| Test Number | Steel grade | Amount of Zn—Fe intermetallic compound ($g/m^2$) | Average diameter of particulate matter (nm) | Number of particulate matter log (pcs/mm) | Plating stuck to mold Existent or not | Formation of Fe scale Existent or not | Painting adhesiveness | Remarks |
| 67 | A | 0.0 | 21 | 3.4 | No | No | AA | Example |
| 68 | A | 17.4 | 18 | 1.7 | Yes | No | AA | Comparative Example |
| 69 | A | Unevaluable due to formation of Fe scales over the entire surface | | | Fe scale sticking | Yes | C | Comparative Example |
| 70 | A | 0.0 | 8 | 0.4 | No | Yes | C | Comparative Example |
| 71 | A | 0.0 | 4 | 0.2 | No | Yes | C | Comparative Example |
| 72 | A | 0.0 | 12 | 0.4 | No | Yes | C | Comparative Example |
| 73 | A | 0.0 | 16 | 0.3 | No | Yes | C | Comparative Example |
| 74 | A | 22.0 | 20 | 1.8 | Yes | No | AA | Comparative Example |

Although the invention has been described in terms of the preferred Embodiments and Examples according to the invention, such Embodiments and Examples are just an example within the range of the essentials of the invention, and addition, omission, replacement, and other alternations of the constitution without departing from the spirit of the invention are possible. Namely, the foregoing description is not intended to limit the scope of the invention, and various alterations are no doubt possible within the scope of the invention.

The entire contents of the disclosures by Japanese Patent Application No. 2013-122351 are incorporated herein by reference.

All the literature, patent application, and technical standards cited herein are also herein incorporated to the same extent as provided for specifically and severally with respect to an individual literature, patent application, and technical standard to the effect that the same should be so incorporated by reference.

The invention claimed is:

1. A hot stamp molded body produced by hot-stamping an electrogalvanized steel sheet, the steel sheet comprising, by mass %:

C: from 0.10 to 0.35%,
Si: from 0.01 to 3.00%,
Al: from 0.01 to 3.00%,
Mn: from 1.0 to 3.5%,
P: from 0.001 to 0.100%,
S: from 0.001 to 0.010%,
N: from 0.0005 to 0.0100%,
Ti: from 0.000 to 0.200%,
Nb: from 0.000 to 0.200%,
Mo: from 0.00 to 1.00%,
Cr: from 0.00 to 1.00%,
V: from 0.000 to 1.000%,
Ni: from 0.00 to 3.00%,
B: from 0.0000 to 0.0050%,
Ca: from 0.0000 to 0.0050%, and
Mg: from 0.0000 to 0.0050%,
a balance being Fe and impurities, wherein the steel sheet is electrogalvanized on each face with a plating weight not less than 5 $g/m^2$ and less than 40 $g/m^2$;

wherein a galvanized layer of the hot stamp molded body is configured with 0 $g/m^2$ to 15$g/m^2$ of a Zn-Fe intermetallic compound and a Fe-Zn solid solution phase as a balance, wherein, in the galvanized layer of the hot stamp molded body, $1\times10$ pcs to $1\times10^4$ pcs of particulate matter with an average diameter of from 10 nm to 1 μm are present per 1 mm length of the galvanized layer, wherein the particulate matter contains one, or two or more kinds of single oxides or complex oxides or a complex structure of single oxides and complex oxides, of Si, Mn, Cr, and Al, wherein the single oxides comprise one or more of MnO, $MnO_2$, $Mn_2O_3$, $Mn_3O_4$, $SiO_2$, $Al_2O_3$, $Cr_2O_3$, and non-stoichiometric compositions thereof, and wherein the complex oxides comprise one or more of $FeSiO_3$, $Fe_2SiO_4$, $MnSiO_3$, $Mn_2SiO_4$, $AlMnO_3$, $FeCr_2O_4$, $Fe_2CrO_4$, $MnCr_2O_4$, $Mn_2CrO_4$, and non-stoichiometric compositions thereof.

2. The hot stamp molded body according to claim 1, wherein the steel sheet comprises, by mass %, one or more of:

Ti: from 0.001 to 0.200%,
Nb: from 0.001 to 0.200%,
Mo: from 0.01 to 1.00%,
Cr: from 0.01 to 1.00%,
V: from 0.001 to 1.000%,
Ni: from 0.01 to 3.00%,
B: from 0.0002 to 0.0050%,
Ca: from 0.0002 to 0.0050%, or
Mg: from 0.0002 to 0.0050%.

3. The hot stamp molded body according to claim 1, wherein the electrogalvanized steel sheet is an electrolytic zinc alloy-coated steel sheet.

4. The hot stamp molded body according to claim 1, wherein inside the galvanized layer of the hot stamp molded body, $1\times10$ pcs to $1\times10^4$ pcs of particulate matter with an average diameter of from 10 nm to 1 μm are present per 1 mm length of the galvanized layer.

5. A method for producing a hot stamp molded body according to claim 1, the method comprising subjecting a steel comprising, by mass %:

C: from 0.10 to 0.35%,
Si: from 0.01 to 3.00%,
Al: from 0.01 to 3.00%,

Mn: from 1.0 to 3.5%,
P: from 0.001 to 0.100%,
S: from 0.001 to 0.010%,
N: from 0.0005 to 0.0100%,
Ti: from 0.000 to 0.200%,
Nb: from 0.000 to 0.200%,
Mo: from 0.00 to 1.00%,
Cr: from 0.00 to 1.00%,
V: from 0.000 to 1.000%,
Ni: from 0.00 to 3.00%,
B: from 0.0000 to 0.0050%,
Ca: from 0.0000 to 0.0050%, and
Mg: from 0.0000 to 0.0050%, a balance being Fe and impurities, to hot rolling, pickling, cold rolling, continuous annealing, temper rolling, and electrogalvanizing to yield an electrogalvanized steel sheet, and subjecting the electrogalvanized steel sheet to hot stamp molding to produce a hot stamp molded body;

wherein the continuous annealing includes subjecting the steel sheet to repeated bending at a bending angle of from 90° to 220° four or more times during heating of the steel sheet in an atmosphere gas containing hydrogen at from 0.1 volume % to 30 volume %, $H_2O$ corresponding to a dew point of from −70° C. to −20° C., and nitrogen and impurities as a balance, at a sheet temperature within a range of from 350° C. to 700° C., wherein the electrogalvanizing includes electrogalvanizing each face of the steel sheet with a plating weight of not less than 5 g/m$^2$ and less than 40 g/m$^2$, and wherein the hot stamp molding includes heating the electrogalvanized steel sheet with an average temperature elevation rate of 50° C./sec or more to a temperature range of from 700° C. to 1100° C., hot stamping within 1 min from the initiation of the temperature elevation, and thereafter cooling to normal temperature, therefore producing the hot stamp molded body of claim 1.

6. The method for producing a hot stamp molded body according to claim 5, wherein the steel comprises, by mass %, one or more of:

Ti: from 0.001 to 0.200%,
Nb: from 0.001 to 0.200%,
Mo: from 0.01 to 1.00%,
Cr: from 0.01 to 1.00%,
V: from 0.001 to 1.000%,
Ni: from 0.01 to 3.00%,
B: from 0.0002 to 0.0050%,
Ca: from 0.0002 to 0.0050%, or
Mg: from 0.0002 to 0.0050%.

* * * * *